US010978846B2

(12) United States Patent
Takada

(10) Patent No.: US 10,978,846 B2
(45) Date of Patent: Apr. 13, 2021

(54) WIRE TERMINAL CRIMPING METHOD

(71) Applicant: Yazaki Corporation, Tokyo (JP)

(72) Inventor: Kazuhiko Takada, Makinohara (JP)

(73) Assignee: Yazaki Corporation, Tokyo (JP)

( * ) Notice: Subject to any disclaimer, the term of this patent is extended or adjusted under 35 U.S.C. 154(b) by 293 days.

(21) Appl. No.: 16/019,789

(22) Filed: Jun. 27, 2018

(65) Prior Publication Data

US 2019/0006809 A1 Jan. 3, 2019

(30) Foreign Application Priority Data

Jun. 28, 2017 (JP) ..... JP2017-126626

(51) Int. Cl.

| | |
|---|---|
| ***H01R 43/04*** | (2006.01) |
| ***H01R 43/048*** | (2006.01) |
| ***H01R 43/058*** | (2006.01) |
| ***H01R 43/052*** | (2006.01) |
| ***H01R 43/055*** | (2006.01) |

(52) U.S. Cl.

CPC ..... *H01R 43/0488* (2013.01); *H01R 43/052* (2013.01); *H01R 43/055* (2013.01); *H01R 43/058* (2013.01)

(58) Field of Classification Search

CPC ..... H01R 43/0488; H01R 43/055; H01R 43/058; H01R 43/052; H01R 43/048; Y10T 29/49174; Y10T 29/49181; Y10T 29/49185; Y10T 29/53209

USPC ..... 29/854, 861, 863, 747

See application file for complete search history.

(56) References Cited

U.S. PATENT DOCUMENTS

| | | | | |
|---|---|---|---|---|
| 5,606,795 | A | 3/1997 | Ohba et al. | |
| 5,659,949 | A | 8/1997 | Ohba et al. | |
| 5,913,934 | A | 6/1999 | Inoue et al. | |
| 9,548,581 | B2 * | 1/2017 | Nicholas | H01R 43/055 |
| 2007/0129822 | A1 | 6/2007 | Nicholas | |
| 2014/0331495 | A1 | 11/2014 | Nicholas et al. | |

FOREIGN PATENT DOCUMENTS

| | | | |
|---|---|---|---|
| JP | S61-071577 | A | 4/1986 |
| JP | H06-223646 | A | 8/1994 |
| JP | H10-012349 | A | 1/1998 |

(Continued)

OTHER PUBLICATIONS

Oct. 17, 2018—(EP) Extended Search Report—App 18180481.6.
May 7, 2019—(JP) Notice of Reasons for Refusal—App 2017-126626, Eng Tran.

*Primary Examiner* — Donghai D Nguyen
(74) *Attorney, Agent, or Firm* — Banner & Witcoff, Ltd.

(57) ABSTRACT

A terminal crimping device crimps a terminal metal fitting positioned at a crimping position to an electric wire. The device includes an anvil which is positioned under the crimping position, a crimper which is positioned above the crimping position, a pressing mechanism which presses down the crimper to crimp the terminal metal fitting to the electric wire with the anvil and the crimper, a terminal supply mechanism to supply the terminal metal fitting to the crimping position, a position adjusting mechanism which is provided in the terminal supply mechanism to adjust a position of the terminal metal fitting for the crimping position, and a photographing device to photograph the terminal metal fitting fed to the crimping position.

3 Claims, 21 Drawing Sheets

(56) References Cited

FOREIGN PATENT DOCUMENTS

| | | | |
|---|---|---|---|
| JP | H10-112370 | A | 4/1998 |
| JP | H11-251028 | A | 9/1999 |
| JP | 3186531 | B2 | 7/2001 |
| JP | 2005-135822 | A | 5/2005 |
| JP | 2007-258032 | A | 10/2007 |
| JP | 2014-220215 | A | 11/2014 |
| WO | 2014181729 | A1 | 11/2014 |

* cited by examiner

WIRE TERMINAL CRIMPING METHOD

CROSS REFERENCE TO RELATED APPLICATIONS

This application claims priority from Japanese Patent Application No. 2017-126626 filed on Jun. 28, 2017, the entire contents of which are incorporated herein by reference.

BACKGROUND OF THE INVENTION

Field of the Invention

The present invention relates to a terminal crimping device and a terminal crimping method for crimping and connecting a terminal metal fitting to an end part of an electric wire.

Description of Related Art

In manufacturing of a wire harness, there is provided a crimping process of crimping a terminal metal fitting to an end part of an electric wire by a crimping machine installed on a workbench (for example, see the patent document 1: JP-A-6-223646).

As the crimping machine used in the crimping process, a multi-crimping device has been known which includes a plurality of pairs of anvils and crimpers corresponding to a plurality of kinds of terminal metal fittings and crimps a terminal metal fitting to be worked to electric wires by moving a selected pair of an anvil and a crimper to a common crimping position (for example, see the patent document 2: JP-A-2005-135822 and see the patent document 3: JP-A-10-12349).

[Patent Document 1] JP-A Hei 6-223646
[Patent Document 2] JP-A 2005-135822
[Patent Document 3] JP-A Hei 10-12349

However, in a case where the kind of terminal metal fitting to be crimped is changed, it is necessary to exchange a pair of an anvil and a crimper. However, in a case of exchanging a pair of an anvil and a crimper, a complicated adjustment operation for accurately feeding a terminal metal fitting to a predetermined position of a crimping position corresponding to the anvil and the crimper has to be performed. The complicated adjustment operation with change of the anvil and the crimper is unavoidable even in a multi-crimping device capable of changing an anvil and a crimper. Therefore, in a crimping process, labor for changing a terminal metal fitting to be crimped is required and particularly, in a case of crimping various kinds of terminal metal fittings, productivity is poor.

SUMMARY

One or more embodiments provide a terminal crimping device and a terminal crimping method capable of improving productivity and quality by smoothly crimping a plurality of kinds of terminal metal fittings to electric wires.

(1) A terminal crimping device which crimps a terminal metal fitting positioned at a crimping position to an electric wire, the device includes an anvil which is positioned under the crimping position, a crimper which is positioned above the crimping position, a pressing mechanism which presses down the crimper to crimp the terminal metal fitting to the electric wire with the anvil and the crimper, a terminal supply mechanism to supply the terminal metal fitting to the crimping position, a position adjusting mechanism which is provided in the terminal supply mechanism to adjust a position of the terminal metal fitting for the crimping position, a photographing device to photograph the terminal metal fitting fed to the crimping position, and a control device which controls the position adjusting mechanism based on a video image photographed by the photographing device to perform a positioning process of matching a position of the terminal metal fitting with a predetermined position of the crimping position.

(2) The terminal crimping device according to (1), wherein the anvil includes a wire anvil and a coated anvil, wherein the crimper includes a wire crimper which is paired with the wire anvil to caulk the terminal metal fitting to a conductor of the electric wire, and a coated crimper which is paired with the coated anvil to caulk the terminal metal fitting to a coating part of the electric wire, and wherein the pressing mechanism includes a wire crimper pressing part which presses down the wire crimper, a coated crimper pressing part which presses down the coated crimper, and a height adjusting mechanism which adjusts a relative height position between the wire crimper pressing part and the coated crimper pressing part.

(3) The terminal crimping device according to (2), wherein the wire crimper pressing part and the coated crimper pressing part are attached to a pressing block in which is lifted by the pressing mechanism, and wherein the height adjusting mechanism includes a wedge part which is inserted between the pressing block and the wire crimper pressing part or between the pressing block and the coated crimper pressing part to change a relative position between both members.

(4) The terminal crimping device according to any one of (1) to (3), further includes a multiapplicator including a plurality of pairs of the anvils and the crimpers respectively crimping a plurality of kinds of terminal metal fittings to the electric wires, wherein the multiapplicator selects a pair of the anvil and the crimper corresponding to the terminal metal fitting fed to the crimping position and positioned the anvil and the crimper at the anvil crimping position.

(5) The terminal crimping device according to any one of (1) to (4), wherein a terminal magazine in which a plurality of terminal holders which respectively hold the various terminal metal fittings are positioned is detachably attached to the terminal supply mechanism, and wherein the terminal supply mechanism transports the terminal metal fittings held by the terminal holders to the crimping position by moving the terminal magazine.

According to the terminal crimping device having the above configuration of (1), based on the video image photographed by the photographing device, the control device controls the position adjusting mechanism to perform a positioning process of matching the position of the terminal metal fitting with a predetermined position of the crimping position. Even in a case where the anvil and the crimper are exchanged with change of the kind of the terminal metal fitting to be crimped, the terminal metal fitting can be crimped to the electric wire by positioning the terminal metal fitting at a predetermined position of the crimping position corresponding to the exchanged anvil and crimper with high accuracy, and thus productivity and quality can be improved.

According to the terminal crimping device having the above configuration of (2), the relative height position between the wire crimper and the coated crimper can be adjusted by the height adjusting mechanism depending on the size and the shape of the terminal metal fitting and the kind and the diameter of the electric wire to which the terminal metal fitting is crimped. Here, the press down amount of the coated crimper according to the crimp height of the coated crimp part (the height of the coated crimp part) can be easily adjusted in accordance with the press down amount of the wire crimper according to the crimp height of a conductor crimp part (the height of the conductor crimp part). Accordingly, even in a case where the size and the shape of the terminal metal fitting to be crimped and the kind and the diameter of the electric wire are changed, labor for the adjustment operation is further reduced. Thus, productivity can be increased and quality can also be improved.

According to the terminal crimping device having the above configuration of (3), the relative height position between the wire crimper pressing part and the coated crimper pressing part is adjusted by inserting the wedge part of the height adjusting mechanism between the pressing block and the wire crimper pressing part or between the pressing block and the coated crimper pressing part, and thus the relative position between the wire crimper and the coated crimper can be easily adjusted.

According to the terminal crimping device having the above configuration of (4), among a plurality of pairs of anvils and crimpers provided in the multiapplicator, a pair of the anvil and the crimper corresponding to the terminal metal fitting to be crimped are selected, and the terminal metal fitting positioned at a predetermined position of the crimping position by the selected anvil and crimper with high accuracy is crimped to the electric wire. Accordingly, a plurality of kinds of terminal metal fittings can be rapidly crimped to the electric wires with high accuracy and productivity and quality can be improved even in the production of many kinds in small quantities.

According to the terminal crimping device having the above configuration of (5), by mounting the terminal magazine in which the various terminal metal fittings are respectively held by the plurality of kinds of terminal holders on the terminal supply mechanism, the various terminal metal fittings held by the terminal holders are transported to the crimping position and are sequentially crimped to the electric wires. Accordingly, a plurality of supply devices for supplying the terminal metal fittings do not need to be provided for each kind of terminal metal fittings, and the size of the terminal crimping device can be reduced, and an installation space can be reduced.

In order to achieve the above object, a terminal crimping method according to the invention has the following features (6) to (8).

(6) A terminal crimping method includes photographing an electric wire connection part of the terminal metal fitting by a photographing device from an upper side before transporting a terminal metal fitting to be crimped to an electric wire to a crimping position, performing a positioning process of matching a position of the terminal metal fitting with a predetermined position of the crimping position based on a video image photographed by the photographing device, selecting, among a plurality of pairs of anvils and crimpers, a pair of the anvil and the crimper corresponding to the terminal metal fitting to be crimped and positioning the anvil and the crimper at the crimping position, setting an end part of the electric wire of which a conductor is exposed on the electric wire connection part positioned on the anvil supplied to the crimping position and caulking the electric wire connection part with the pair of the anvil and the crimper.

(7) The terminal crimping method according to (6), further includes adjusting a press down amount of the wire crimper in the crimper according to a crimp height of a conductor crimp part in the electric wire connection part and adjusting a press down amount of the coated crimper in the crimper according to a crimp height of a coated crimp part in the electric wire connection part according to the press down amount of the wire crimper.

(8) The terminal crimping method according to (6) or (7), further includes holding the terminal metal fitting by at least one terminal holder attached to a terminal magazine; and moving the terminal magazine in which the terminal metal fitting is held by the terminal holder to the crimping position in a terminal transport direction.

According to the terminal crimping method having the above configuration of (6), based on the video image of the electric wire connection part of the terminal metal fitting photographed by the photographing device, a positioning process of matching the position of the electric wire connection part with a predetermined position of the crimping position is performed. Even in a case where, among a plurality of pairs of anvils and crimpers, a pair of the anvil and the crimper corresponding to the terminal metal fitting to be crimped are selected with change of the kind of the terminal metal fitting to be crimped, and the terminal metal fitting is crimped to the electric wire by the selected pair of the anvil and the crimper, labor for the adjustment operation in which the electric wire connection part of the terminal metal fitting is positioned at a predetermined position of the crimping position corresponding to the exchanged pair of the anvil and the crimper can be reduced, and the electric wire connection part of the terminal metal fitting can be positioned at the predetermined position of the crimping position with high accuracy to crimp the terminal metal fitting to the electric wire. Thus, productivity and quality can be improved.

According to the terminal crimping method having the above configuration of (7), by adjusting the press down amount of the wire crimper according to the crimp height of the conductor crimp part and adjusting the press down amount of the coated crimper according to the crimp height of the coated crimp part according to the press down amount of the wire crimper, even in a case where the size and the shape of the terminal metal fitting to be crimped and the kind and the diameter of the electric wire are changed, labor for the adjustment operation is reduced. Thus, productivity can be increased and quality can be improved.

According to the terminal crimping method having the above configuration of (8), by transporting the terminal magazine in which various terminal metal fittings are respectively held by a plurality of terminal holders to the crimping position, the terminal metal fitting is sequentially crimped to the electric wires. Here, a plurality of supply devices for supplying the terminal metal fittings do not need to be provided for each kind of terminal metal fittings, the size of the terminal crimping device can be reduced, and an installation space can be reduced.

According to the invention, it is possible to provide a terminal crimping device and a terminal crimping method capable of improving productivity and quality by smoothly crimping a plurality of kinds of terminal metal fittings to electric wires.

As described above, the present invention has been simply described. Further, the details of the invention will be further clarified by reading through modes for carrying out the invention which will be described under (hereinafter, also referred to as "embodiments") with reference to accompanying drawings.

BRIEF DESCRIPTION OF THE DRAWINGS

FIGS. 7A and 7B are perspective views illustrating the terminal holder, wherein FIG. 7A is a perspective view in a state in which a locking plate is opened and FIG. 7B is a perspective view in a state in which the locking plate is closed;

FIGS. 8A and 8B are views illustrating the terminal holder, wherein FIG. 8A is a perspective view when viewed from a lower side in a state in which the locking plate is opened and FIG. 8B is perspective view when viewed from the lower side in a state in which the locking plate is closed;

FIGS. 20A and 20B are views illustrating the height adjusting mechanism, wherein FIG. 20A is a perspective view when viewed from the rear side of a pressing block and FIG. 20B is a perspective view when viewed from the front side of the pressing block; and FIGS. 21A and 21B are views illustrating the height adjusting mechanism, wherein FIG. 21A is a back view illustrating the pressing block and FIG. 21B is a front view illustrating the pressing block.

DETAILED DESCRIPTION

Hereinafter, examples of embodiments according to the invention will be described with reference to drawings.

First, a terminal metal fitting to be connected to an electric wire will be described using a terminal crimping device and a terminal crimping method according to embodiments.

Figure 1:
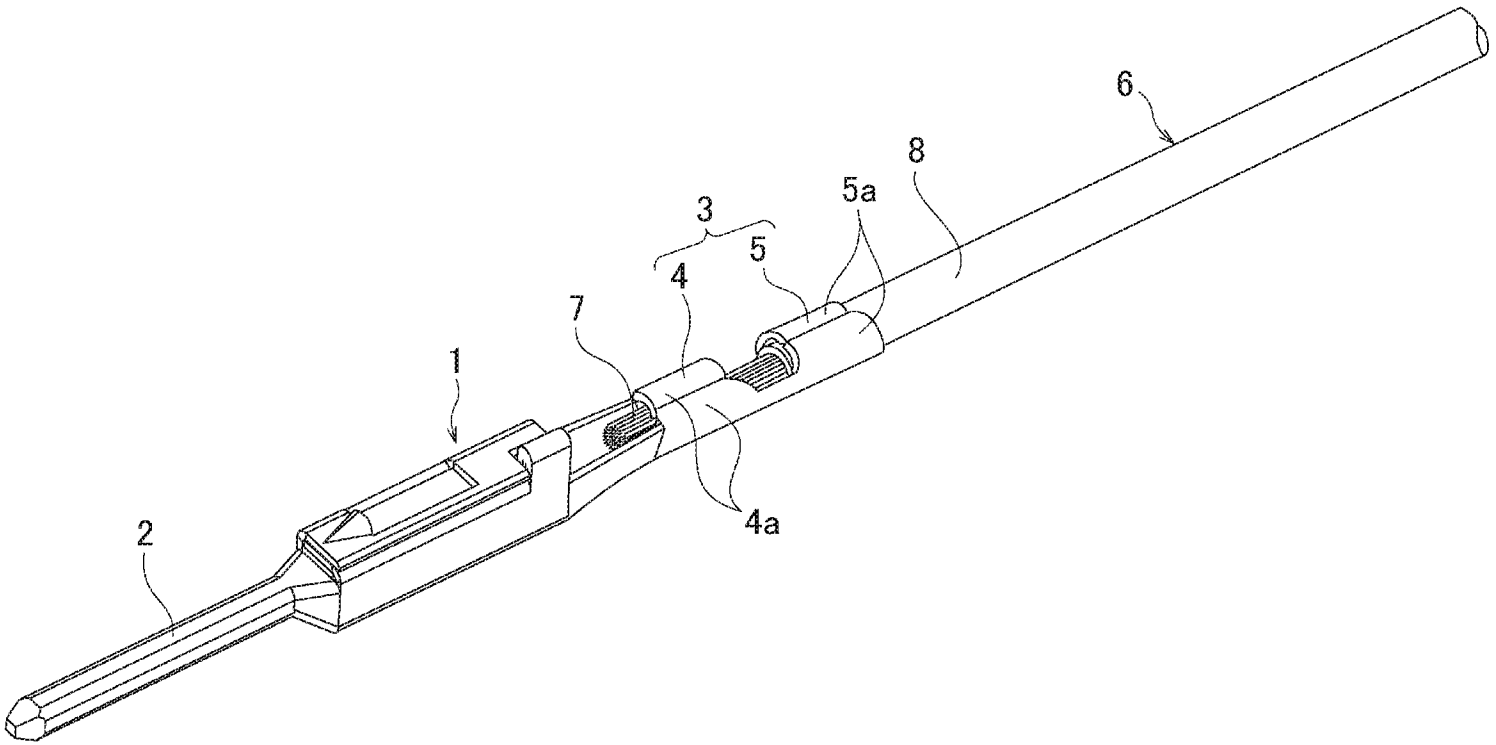
FIG. 1 is a perspective view illustrating an example of a terminal metal fitting crimped to an electric wire.

FIG. 1 is a perspective view illustrating an example of a terminal metal fitting crimped to an electric wire.

As illustrated in FIG. 1, a terminal metal fitting 1 is crimped and electrically connected to an end part of an electric wire 6 constituting, for example, a wire harness positioned to a vehicle such as an automobile. The electric wire 6 is a coated electric wire having a conductor 7 and a coating 8 formed of resin and covering the conductor 7.

The terminal metal fitting 1 includes an electrical connection part 2 in a front side and an electric wire connection part 3 in a rear side. The terminal metal fitting 1 is formed by performing pressing (punching and bending) on a base metal of a conductive metal plate formed of copper or a copper alloy, aluminum or an aluminum alloy, or the like. To the electrical connection part 2, an electrical connection part of the terminal metal fitting of the other connection party is electrically connected.

The electric wire connection part 3 is crimped and electrically connected to the electric wire 6. The electric wire connection part 3 includes a conductor crimp part 4 in a front side and a coated crimp part 5 in a rear side. The conductor crimp part 4 includes a pair of conductor crimping pieces 4*a*, and the coated crimp part 5 includes a pair of coated crimping pieces 5*a*. The conductor 7 exposed at the end part of the electric wire 6 is caulked by the pair of conductor crimping pieces 4*a* of the conductor crimp part 4 from both sides, and the part of the coating 8 (coating part) at the end part of the electric wire 6 is caulked by the pair of coated crimping pieces 5*a* of the coated crimp part 5. Thus, the terminal metal fitting 1 is crimped and electrically connected to the electric wire 6.

As the terminal metal fitting 1, a plurality of kinds of terminal metal fittings having electrical connection parts 2 having various sizes and shapes and connectable to the electrical connection part of the terminal metal fitting of the other connection party may be used. In addition, as the terminal metal fitting 1, a plurality of kinds of terminal metal fittings having electric wire connection parts 3 corresponding to various electric wires 6 having different diameters or kinds of the conductor 7 and the coating 8 may be used.

A terminal crimping device 10 according to the embodiment is a terminal crimping device capable of crimping and connecting the electric wire 6 to a plurality of kinds of terminal metal fittings 1. Hereinafter, the terminal crimping device 10 according to the embodiment will be described.

Figure 2:
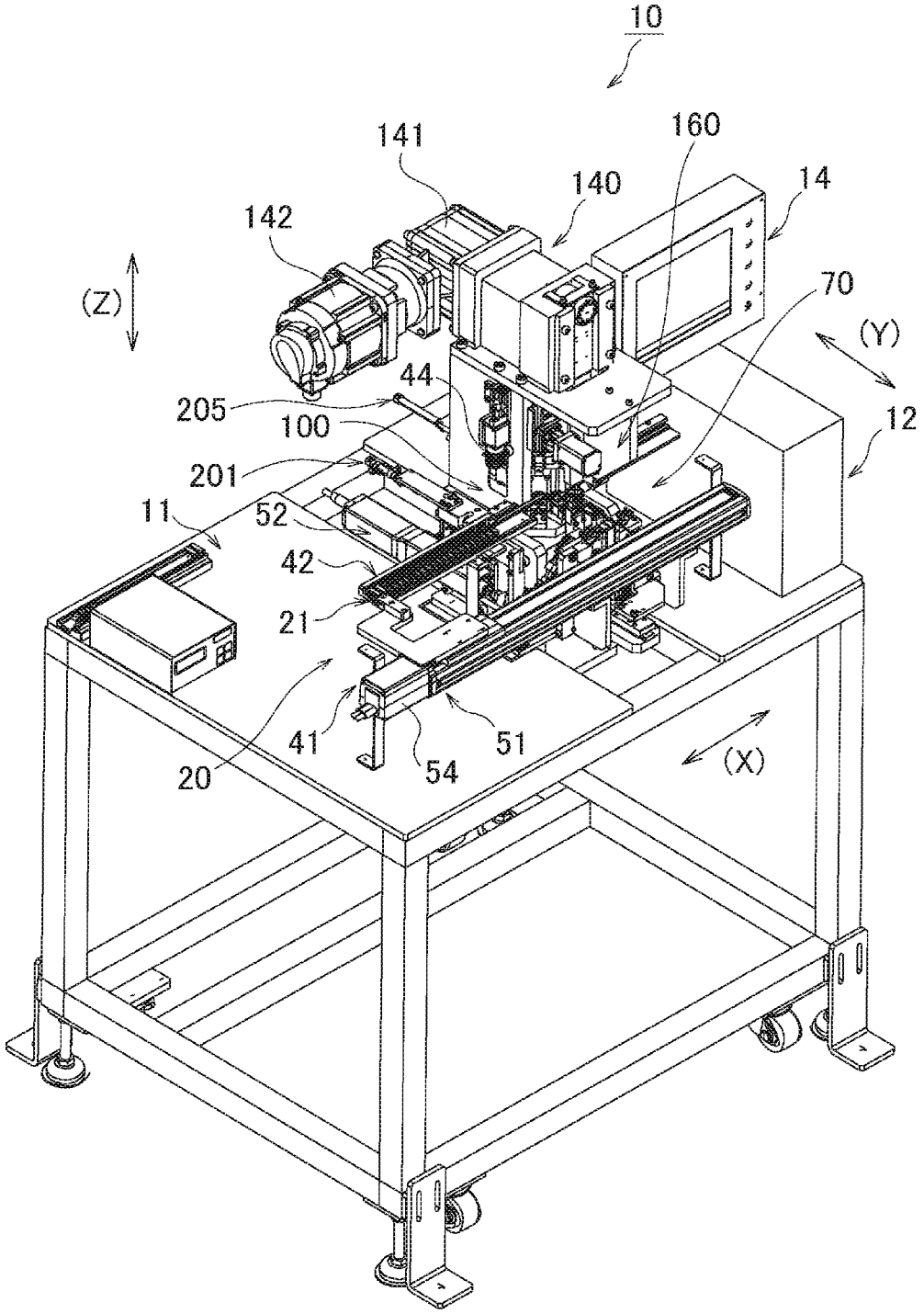
FIG. 2 is a perspective view illustrating a terminal crimping device according to an embodiment.
Figure 3:
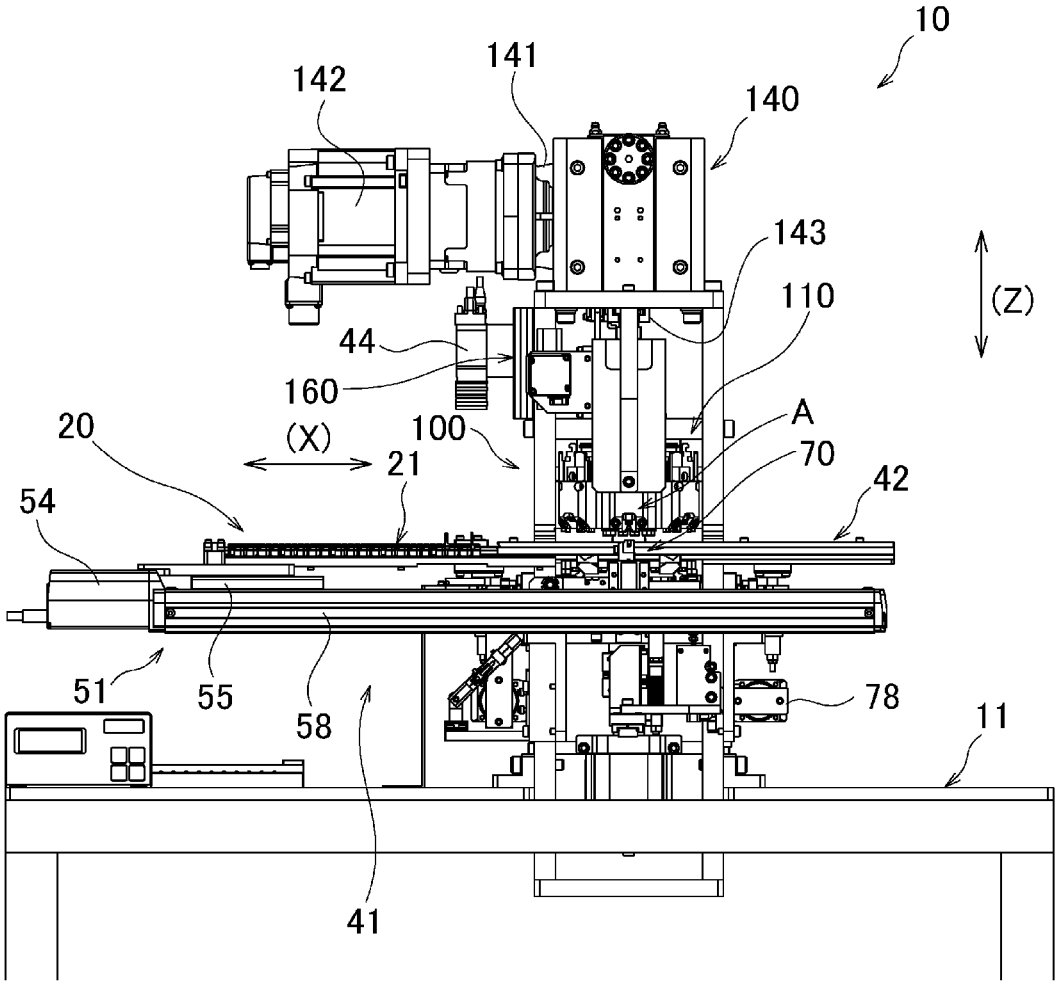
FIG. 3 is a front view illustrating the terminal crimping device according to the embodiment.
Figure 4:
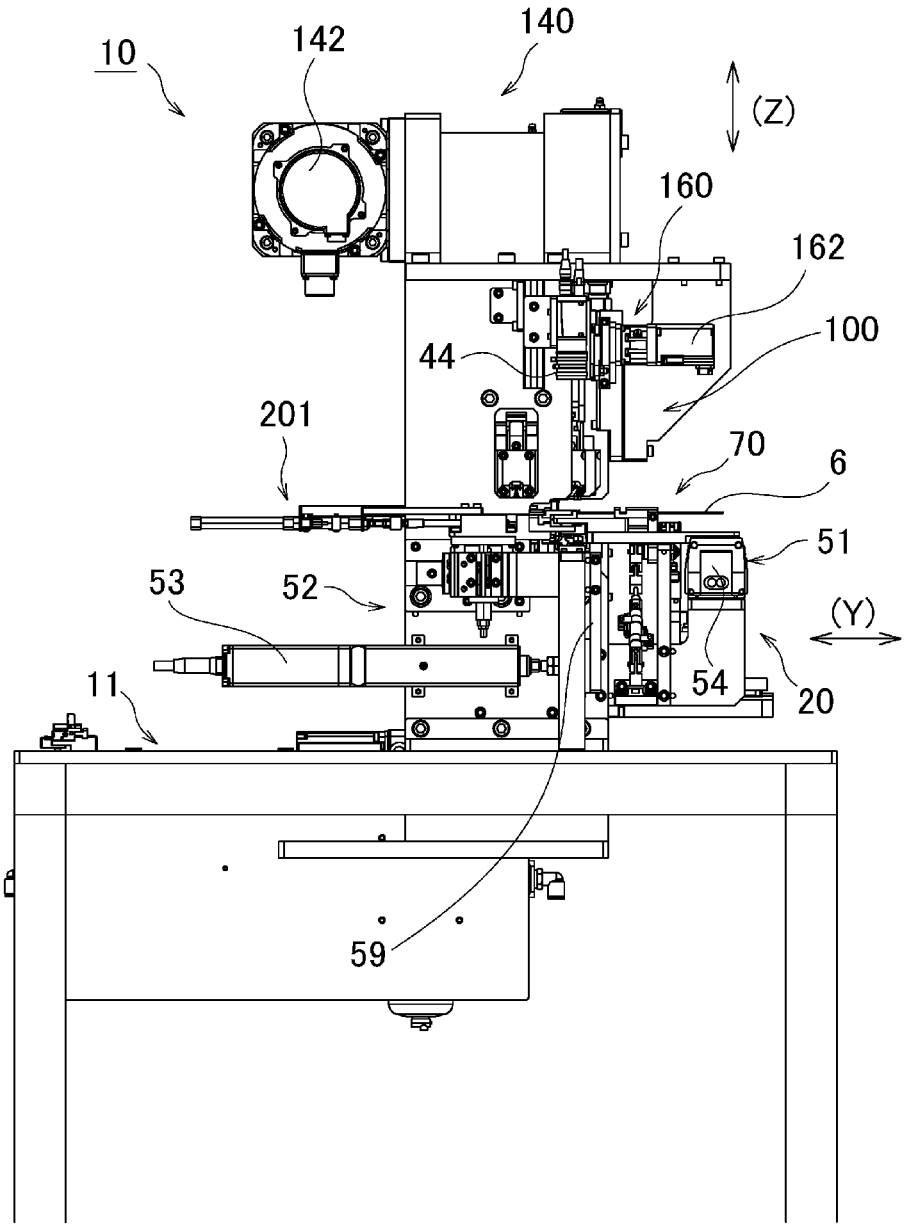
FIG. 4 is a left side view illustrating the terminal crimping device according to the embodiment.

FIGS. 2 to 4 are a perspective view, a front view, and a left side view illustrating the terminal crimping device according to the embodiment.

As shown in FIGS. 2 to 4, the terminal crimping device 10 includes a terminal supply part 20, an electric wire supply part 70, and a terminal crimping part 100. The terminal supply part 20, the electric wire supply part 70, and the terminal crimping part 100 are fixed onto a stand 11.

In addition, the terminal crimping device 10 include a control device 12 for controlling driving of the terminal supply part 20, the electric wire supply part 70, and the terminal crimping part 100, and an operation panel 14, and these control device 12 and operation panel 14 are also fixed onto the stand 11.

In the terminal crimping device 10, the end part of the electric wire 6 of which the conductor 7 is exposed is supplied to the terminal metal fitting 1, which is supplied to a crimping position A by the terminal supply part 20, by the electric wire supply part 70. Then, the conductor crimp part 4 and the coated crimp part 5 of the terminal metal fitting 1 supplied to the crimping position A are caulked by the terminal crimping part 100 to crimp and electrically connect the terminal metal fitting 1 to the end part of the electric wire 6.

Figure 5:
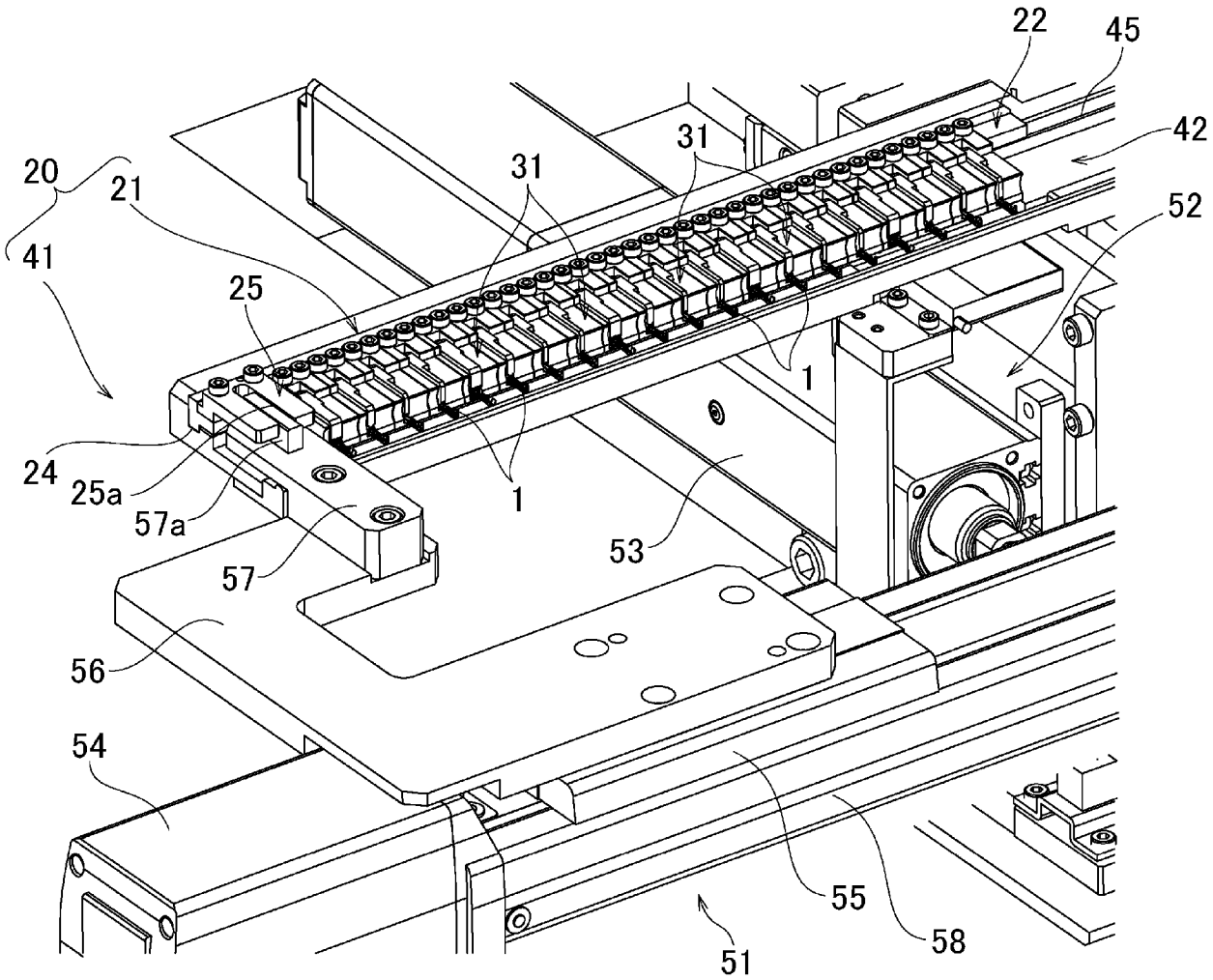
FIG. 5 is a perspective view illustrating a terminal magazine set to a slide rail.
Figure 6:
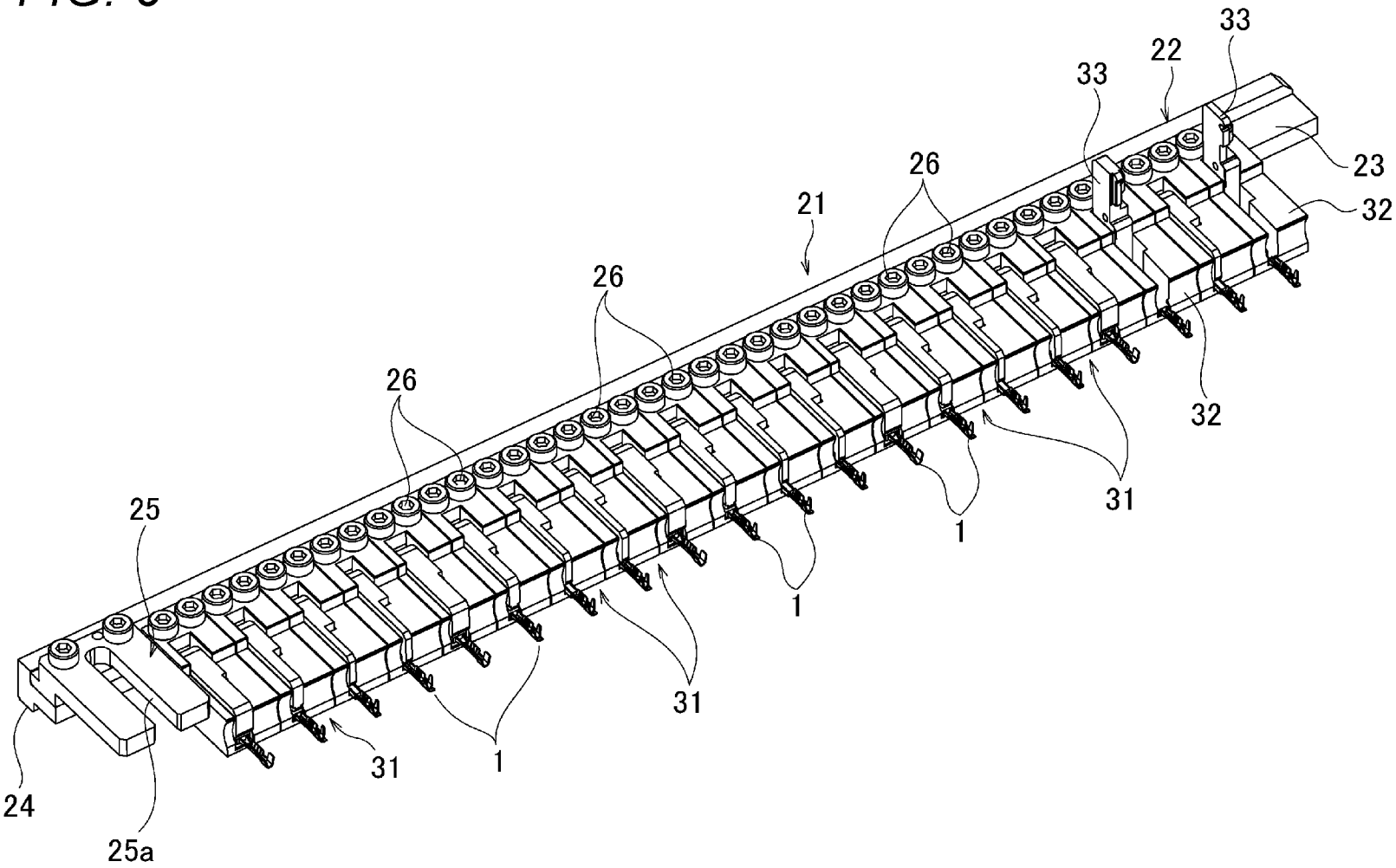
FIG. 6 is a perspective view illustrating the terminal magazine in which the terminal metal fittings are held by terminal holders.
Figure 7A:
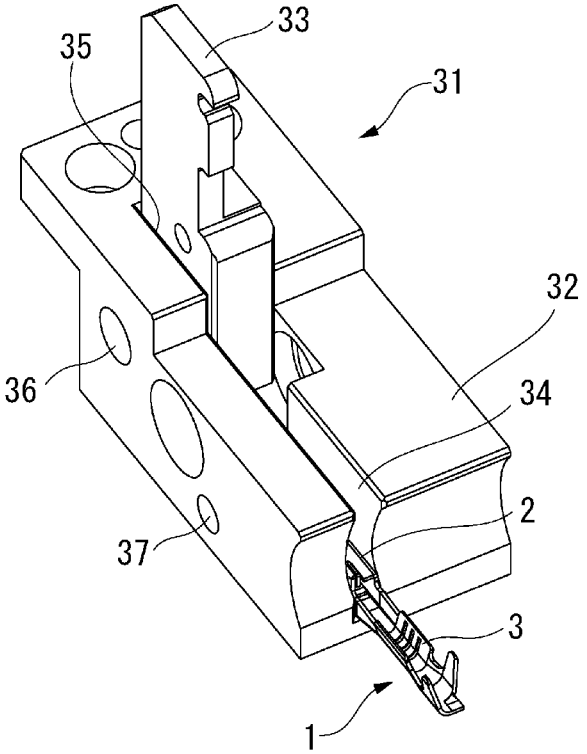
Figure 7B:
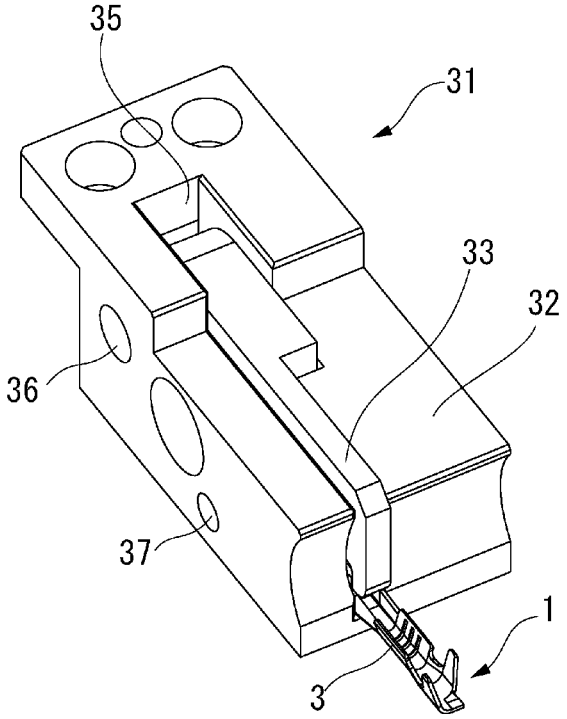

FIG. 5 is a perspective view illustrating a terminal magazine 21 set on a slide rail 42, and FIG. 6 is a perspective view illustrating the terminal magazine 21 in which the terminal metal fitting 1 is held by a terminal holder 31.

As shown in FIGS. 2 and 5, the terminal supply part 20 includes the terminal magazine 21 and a terminal supply mechanism 41. The terminal magazine 21 is detachably attached to the terminal supply mechanism 41. The terminal magazine 21 is held in a state in which a plurality of terminal metal fittings 1 are aligned.

The terminal supply mechanism 41 horizontally moves the terminal magazine 21 in a terminal transport direction (X), and among the plurality of terminal metal fittings 1 held by the terminal magazine 21, a designated terminal metal fitting 1 to be crimped is transported and supplied to the crimping position A.

As shown in FIG. 6, the terminal magazine 21 includes a supporting stand 22 and the plurality of terminal holders 31. The supporting stand 22 is formed in a long shape and a step part 23 is formed on the upper surface thereof. In addition, the supporting stand 22 includes a projection part 24 which extends in a longitudinal direction on the lower surface thereof. A fork-shaped engaging member 25 having a slit 25*a* is fixed on one end side of the supporting stand 22.

Since the plurality of terminal holders 31 hold the terminal metal fittings 1, the terminal holders are detachably attached to the supporting stand by screws 26 which are aligned in the step part 23 of the supporting stand 22. Since the electrical connection parts 2 of the terminal metal fittings 1 are held by these terminal holders 31, the electric wire connection parts 3 of the terminal metal fittings 1 project to the side of the terminal holders. Thus, the electric wire connection parts 3, which project to the side of the terminal holders, of the terminal metal fittings 1 held by each terminal holder 31 are positioned in parallel in the longitudinal direction of the supporting stand 22 with intervals. A plurality of kinds of terminal holders 31 are prepared corresponding to the shape and the size of the electrical connection part 2 of the terminal metal fitting 1. Thus, the terminal holders 31 corresponding to various kinds of terminal metal fittings 1 are fixed to the supporting stand 22.

FIGS. 7A to 9 are a perspective view and an exploded perspective view for illustrating the terminal holder 31 according to the embodiment.

As shown in FIGS. 7A to 9, the terminal holder 31 includes a holder block 32 and a locking plate 33. In the holder block 32, a holding groove 34 is formed, and the electrical connection part 2 of the terminal metal fitting 1 is housed in the holding groove 34. The locking plate 33 is inserted into a window part 35 formed on the rear side of the holding groove 34 of the holder block 32 and is supported to be rotatable by a rotational pin 36. Accordingly, an upper opening of the holding groove 34 is opened or closed in the terminal holder 31 by rotating the locking plate 33. By rotating the locking plate 33 to close the upper opening in a state in which the electrical connection part 2 of the terminal metal fitting 1 is positioned in the holding groove 34, the electrical connection part 2 of the terminal metal fitting 1 is held by the terminal holder 31 and the electric wire connection part 3 projects to the side of the terminal holder 31.

In addition, an abutting pin 37 is inserted into the holder block 32 so as to cross the holding groove 34. A tip end of the electrical connection part 2 of the terminal metal fitting 1 housed in the holding groove 34 abuts on the abutting pin 37. Accordingly, the electric wire connection part 3 of the terminal metal fitting 1 is held by the terminal holder 31 in a state in which the electric wire connection part projects with a predetermined amount of projection. The insertion position of the abutting pin 37 in each holder block 32 varies depending on the kind of terminal metal fitting 1 held by the terminal holder 31. Thus, the electric wire connection parts 3 of the various terminal metal fittings 1 from the holder block 32 have the substantially same projection size, irrespective of kinds of the terminal metal fittings.

Figure 8A:
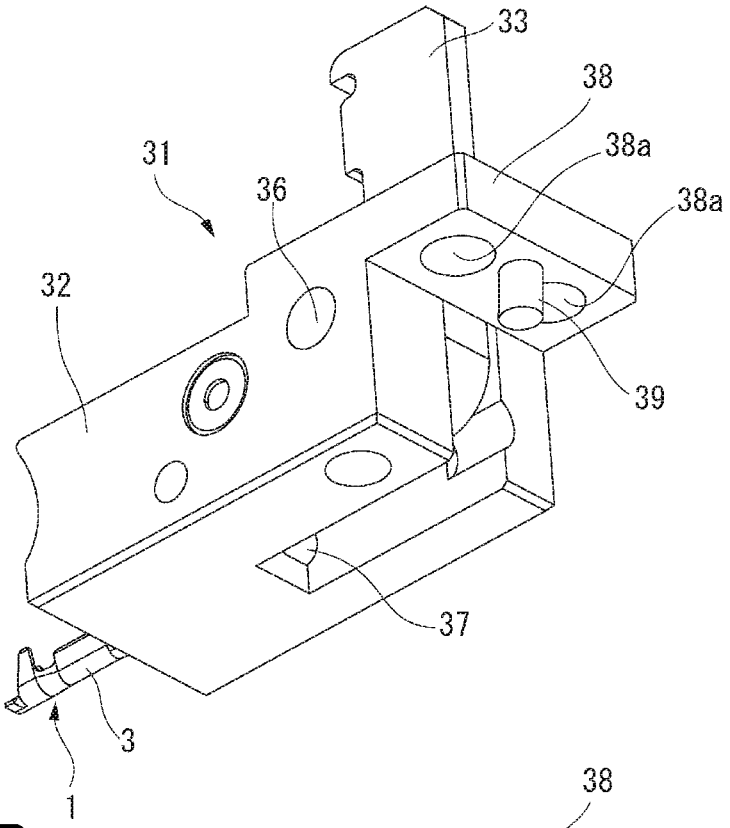
Figure 8B:
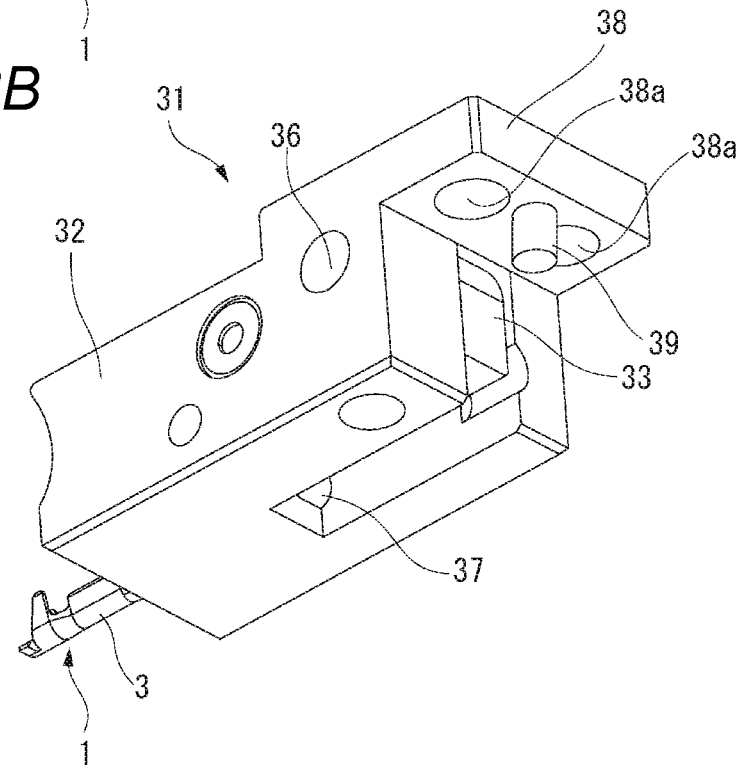
Figure 9:
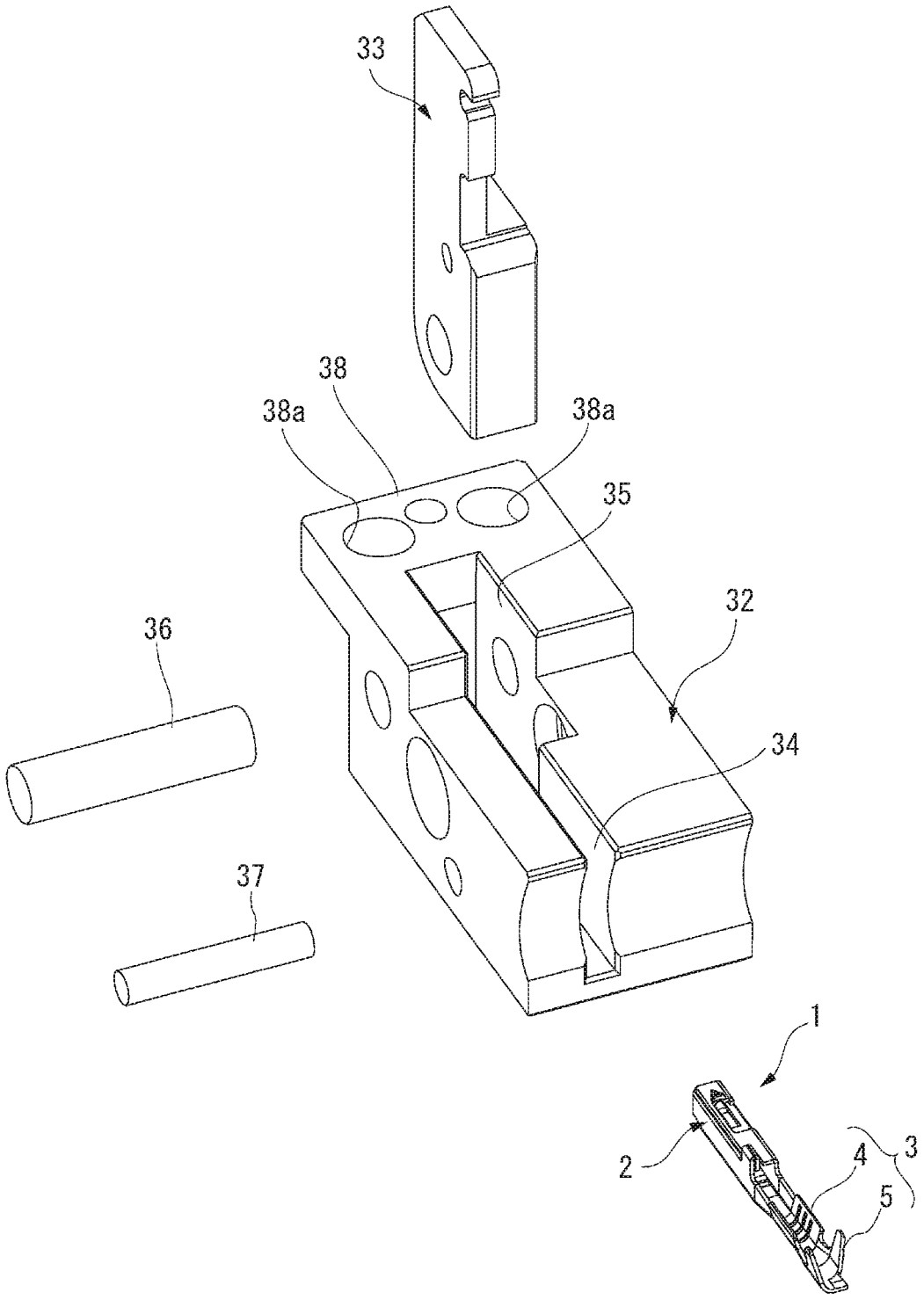
FIG. 9 is an exploded perspective view illustrating the terminal holder.

As shown in FIGS. 8A and 8B, a fixing piece 38 which projects to the rear side is formed in the upper part of the holder block 32 in the terminal holder 31. In the fixing piece 38, a pair of holes 38*a* are formed, and the screws 26 are screwed into screw holes (not shown) of the supporting stand 22 by inserting the screws 26 into the holes 38*a* to fix the terminal holder 31 to the supporting stand 22. In addition, a positioning pin 39 which projects to the lower side is provided in the fixing piece 38, and the terminal holder 31 is positioned on the supporting stand 22 by inserting the positioning pin 39 into a positioning hole (not shown) of the supporting stand 22.

Figure 10:
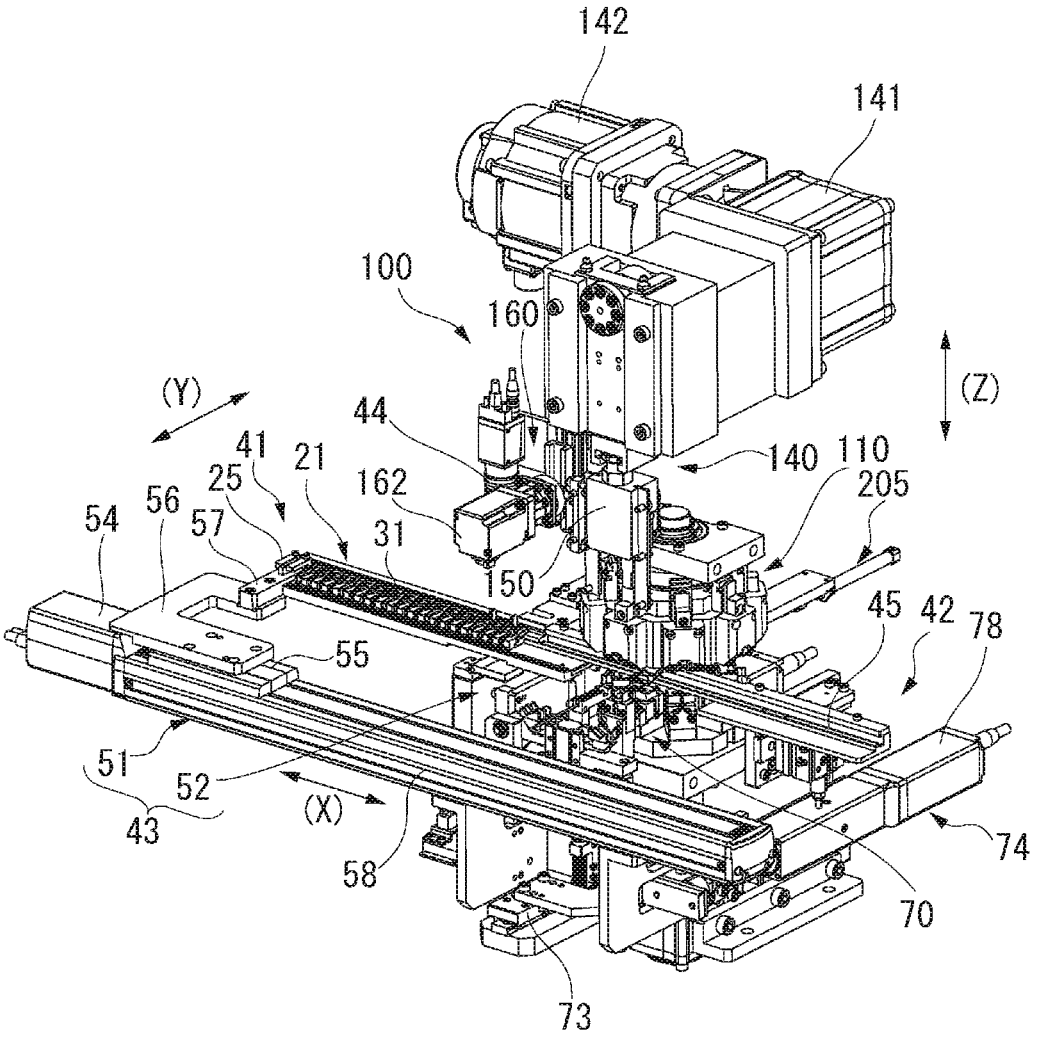
FIG. 10 is a perspective view illustrating a main constitutional part of the terminal crimping device according to the embodiment when viewed from the right side.
Figure 11:
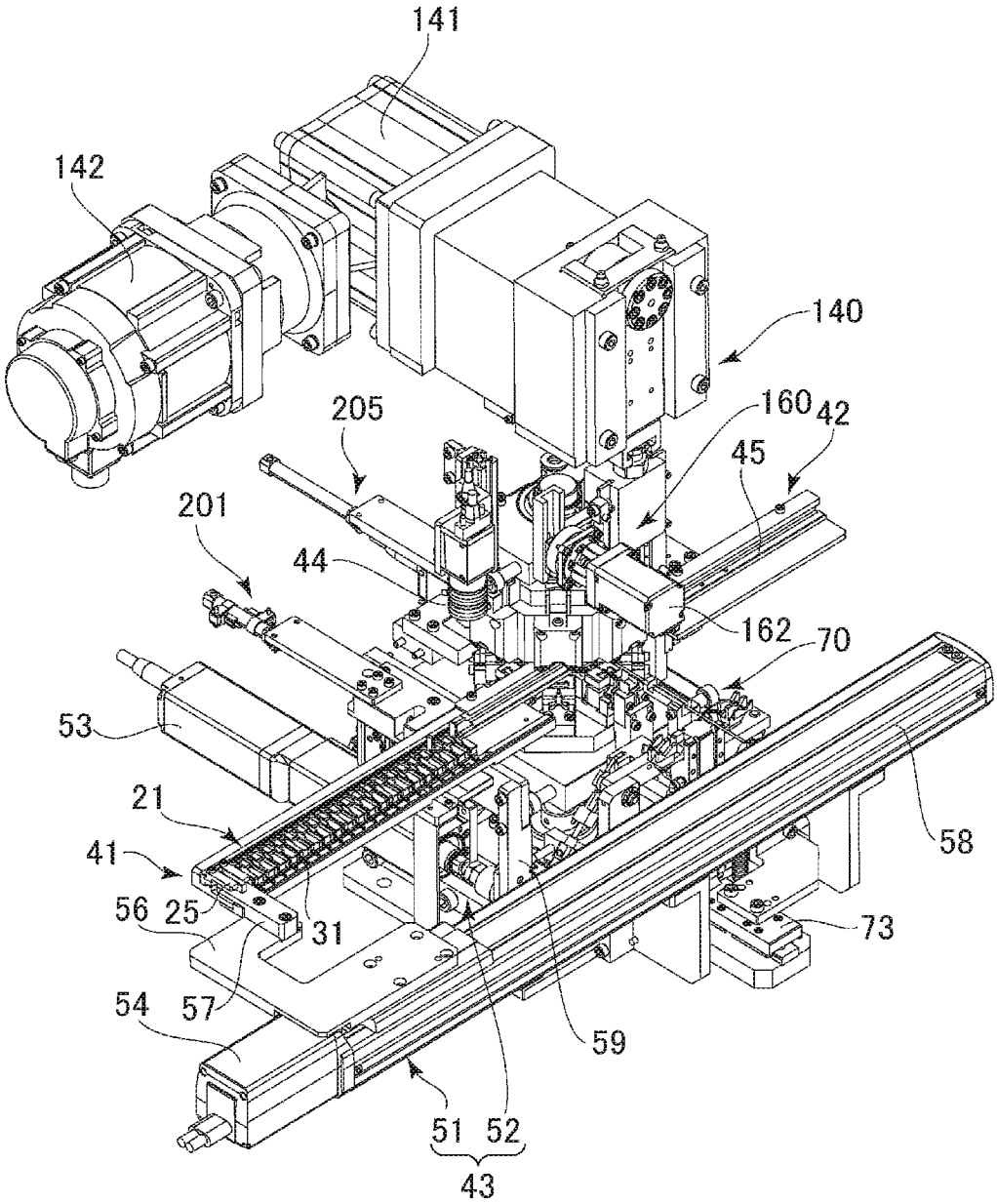
FIG. 11 is a perspective view illustrating the main constitutional part of the terminal crimping device according to the embodiment when viewed from the left side.
Figure 12:
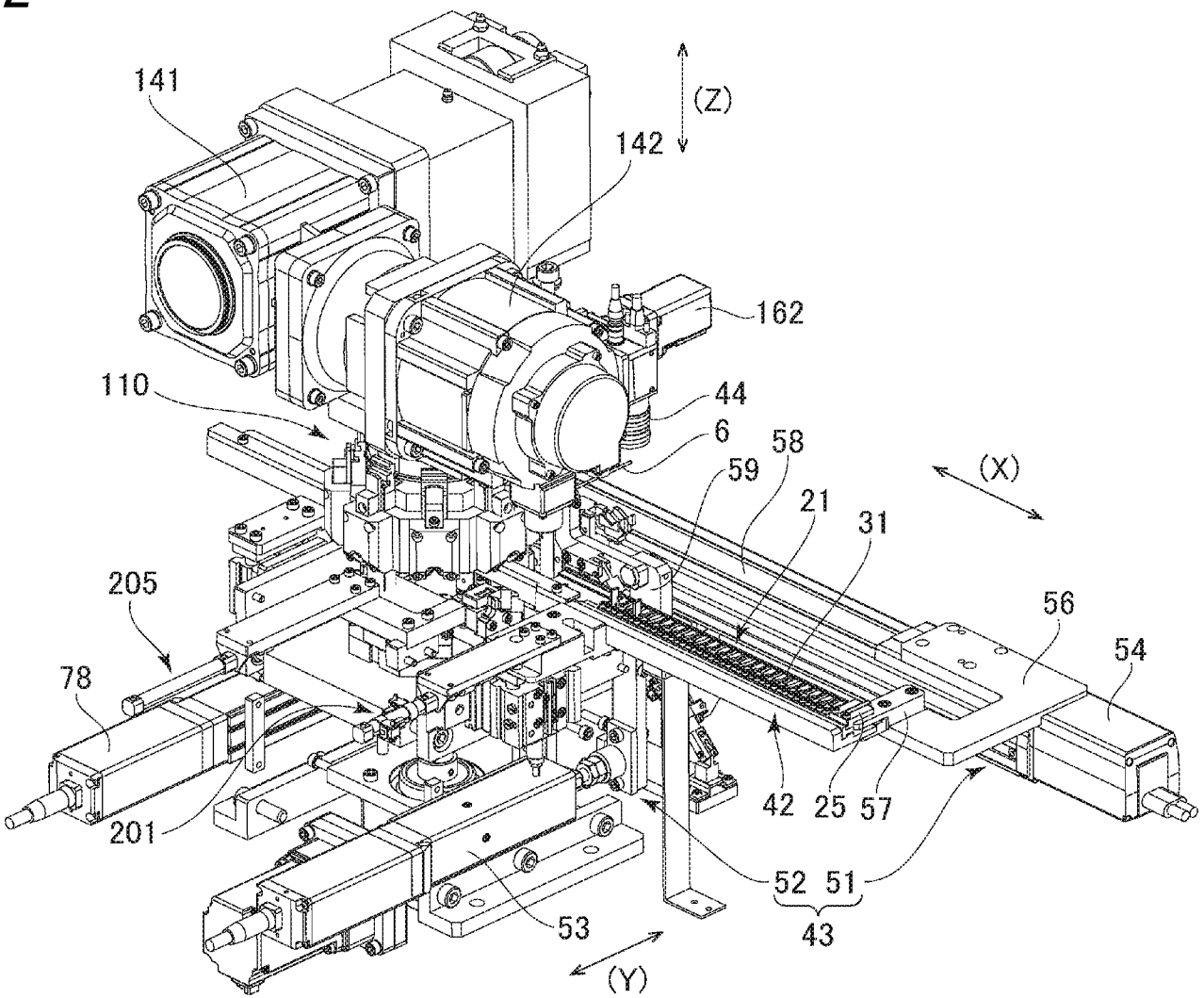
FIG. 12 is a perspective view illustrating the main constitutional part of the terminal crimping device according to the embodiment when viewed from the rear side.

FIGS. 10 to 12 are perspective views illustrating the main configuration part of the terminal crimping device 10 according to the embodiment when viewed from each direction.

As shown in FIGS. 10 to 12, the terminal supply mechanism 41 includes the slide rail 42, a horizontal moving mechanism (position adjusting mechanism) 43, and a camera (photographing device) 44.

The slide rail 42 is positioned horizontally in the terminal transport direction (X) which is the left and right direction of the terminal crimping device 10 (the left and right direction in FIG. 3) so as to pass through the crimping position A. On the slide rail 42, the terminal magazine 21 is placed (refer to FIG. 5). In the slide rail 42, a rail groove 45 is formed in the longitudinal direction, and the projection part 24 which is formed on the supporting stand 22 of the terminal magazine 21 is fitted into the rail groove 45 (refer to FIG. 5). Thus, the terminal magazine 21 placed on the slide rail 42 is slidably supported in the longitudinal direction of the slide rail 42. The slide rail 42 includes a cut in a part including the crimping position A and the vicinity thereof.

A horizontal moving mechanism 43 includes a left and right moving mechanism part 51 and a front and rear moving mechanism part 52. The left and right moving mechanism part 51 includes a slider 55, and the slider 55 moves on a linear guide 58 by a servo motor 54 in the terminal transport direction (X). A connection plate 56 extending to the slide rail 42 side is fixed to the slider 55 (refer to FIG. 5). A connection block 57 having a projection part 57*a* on the upper surface thereof is fixed to the connection plate 56. In the upper part of the connection block 57, an engaging member 25 of the terminal magazine 21 placed on the slide rail 42 is positioned. The projection part 57*a* of the connection block 57 is engaged with the slit 25*a* of the engaging member 25.

Thus, the terminal magazine 21 is connected to be relatively displaceable in an electric wire supply direction (Y) which is the front and rear direction of the terminal crimping device 10 (the left and right direction in FIG. 4) and not to be relatively displaceable in the terminal transport direction (X) with respect to the slider 55. By moving the slider 55 in the terminal transport direction (X) by the left and right moving mechanism part 51, the terminal magazine 21 is moved in the terminal transport direction (X) together with the slider 55. Thus, the terminal metal fitting 1 held by the terminal holder 31 of the terminal magazine 21 is transported to the crimping position A.

The front and rear moving mechanism part 52 includes a rail supporting stand 59 which is connected to the slide rail 42, and an electric cylinder 53 which moves the rail supporting stand 59 in the electric wire supply direction (Y). The electric cylinder 53 of the front and rear moving mechanism part 52 moves the slide rail 42 in the electric wire supply direction (Y) which is the front and rear direction of the terminal crimping device 10 through the rail supporting stand 59. When the slide rail 42 is moved in the electric wire supply direction (Y) by the front and rear moving mechanism part 52, the terminal metal fitting 1 which is held by the terminal holder 31 of the terminal magazine 21 placed on the slide rail 42 and is positioned at the crimping position A is displaced in the electric wire supply direction (Y).

The camera 44 is a photographing device which photographs the electric wire connection part 3 of the terminal metal fitting 1 positioned at the crimping position A. For example, the camera 44 includes an imaging element such as a charge coupled device (CCD), and video data obtained by photographing the crimping position A is transmitted to the control device 12. The control device 12 controls the left and right moving mechanism part 51 and the front and rear moving mechanism part 52 constituting the horizontal moving mechanism 43 based on the video image photographed by the camera 44. Thus, the electric wire connection part 3 of the terminal metal fitting 1 is accurately positioned at a predetermined position of the crimping position A.

Figure 13:
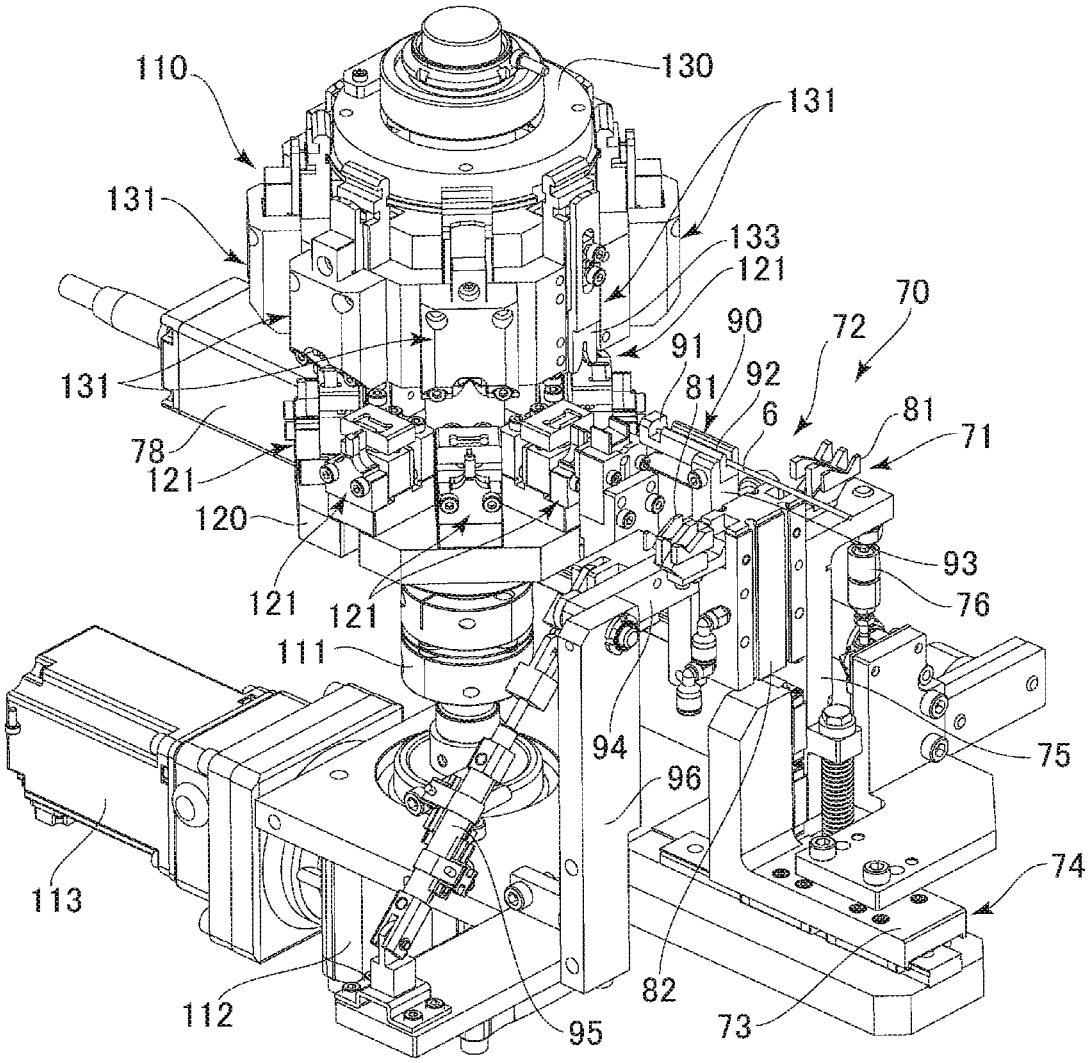
FIG. 13 is a perspective view illustrating an electric wire supply part and a multiapplicator.
Figure 14:
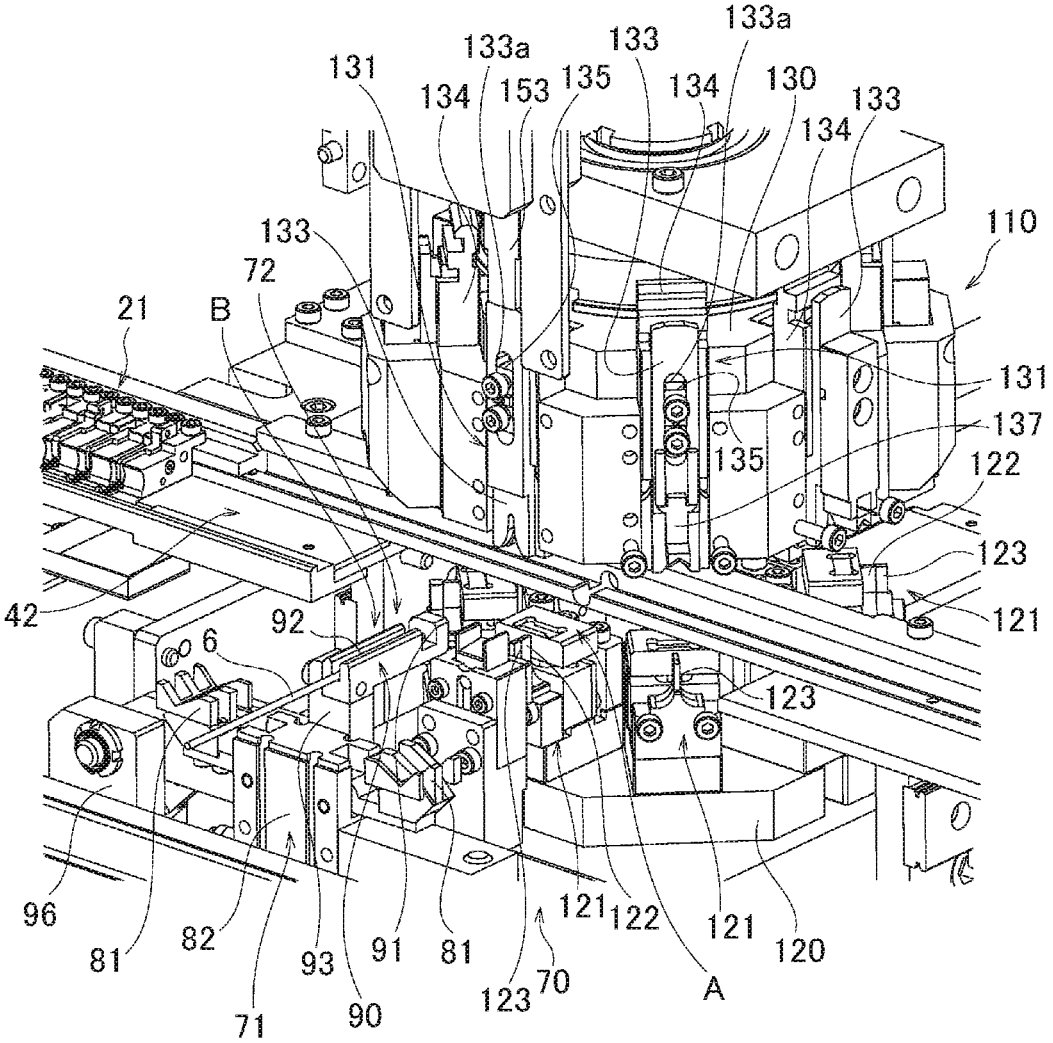
FIG. 14 is a main part perspective view when a crimping position is viewed from the right side.
Figure 15:
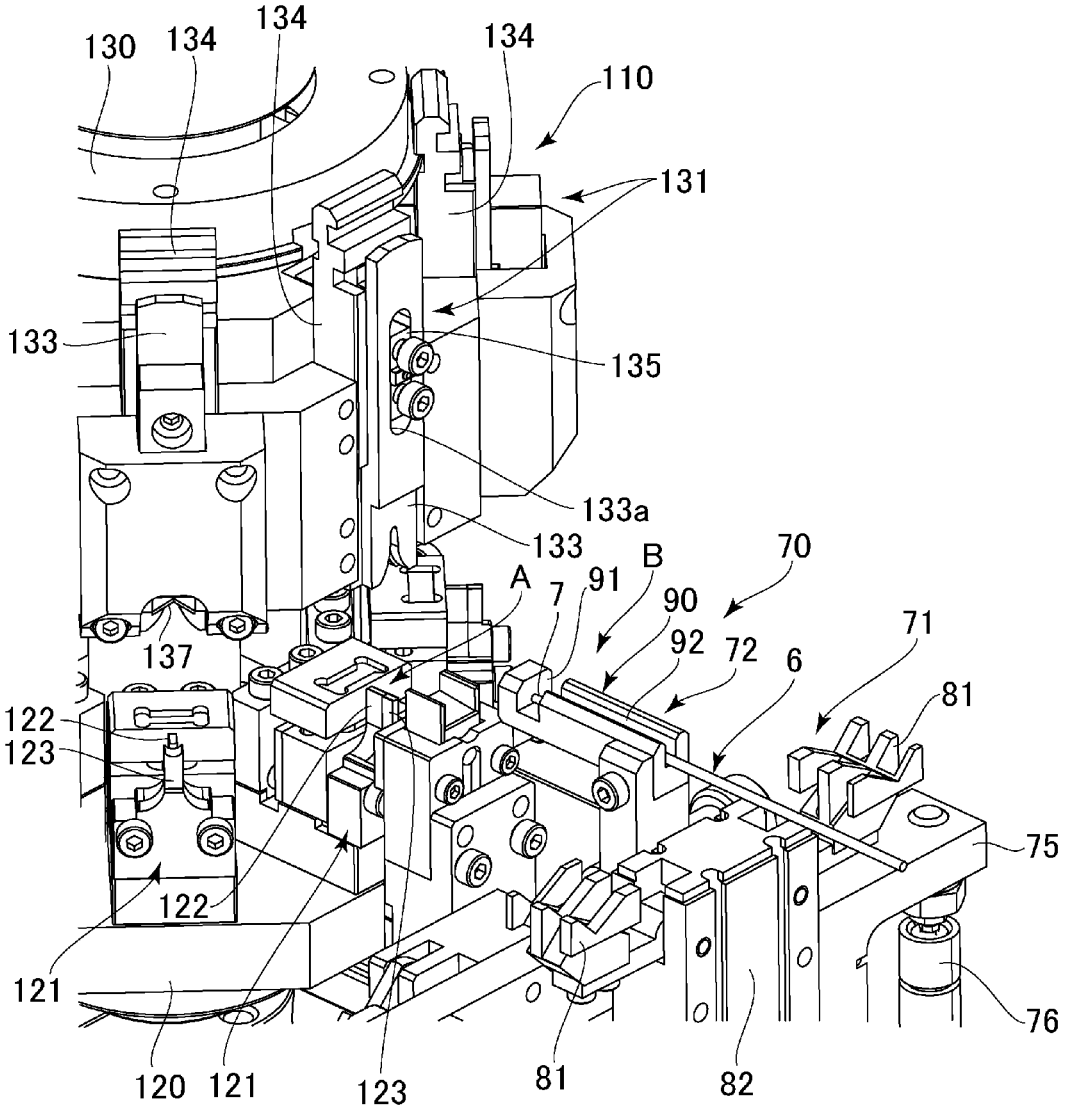
FIG. 15 is a main part perspective view when the crimping position is viewed from the left side.
Figure 16:
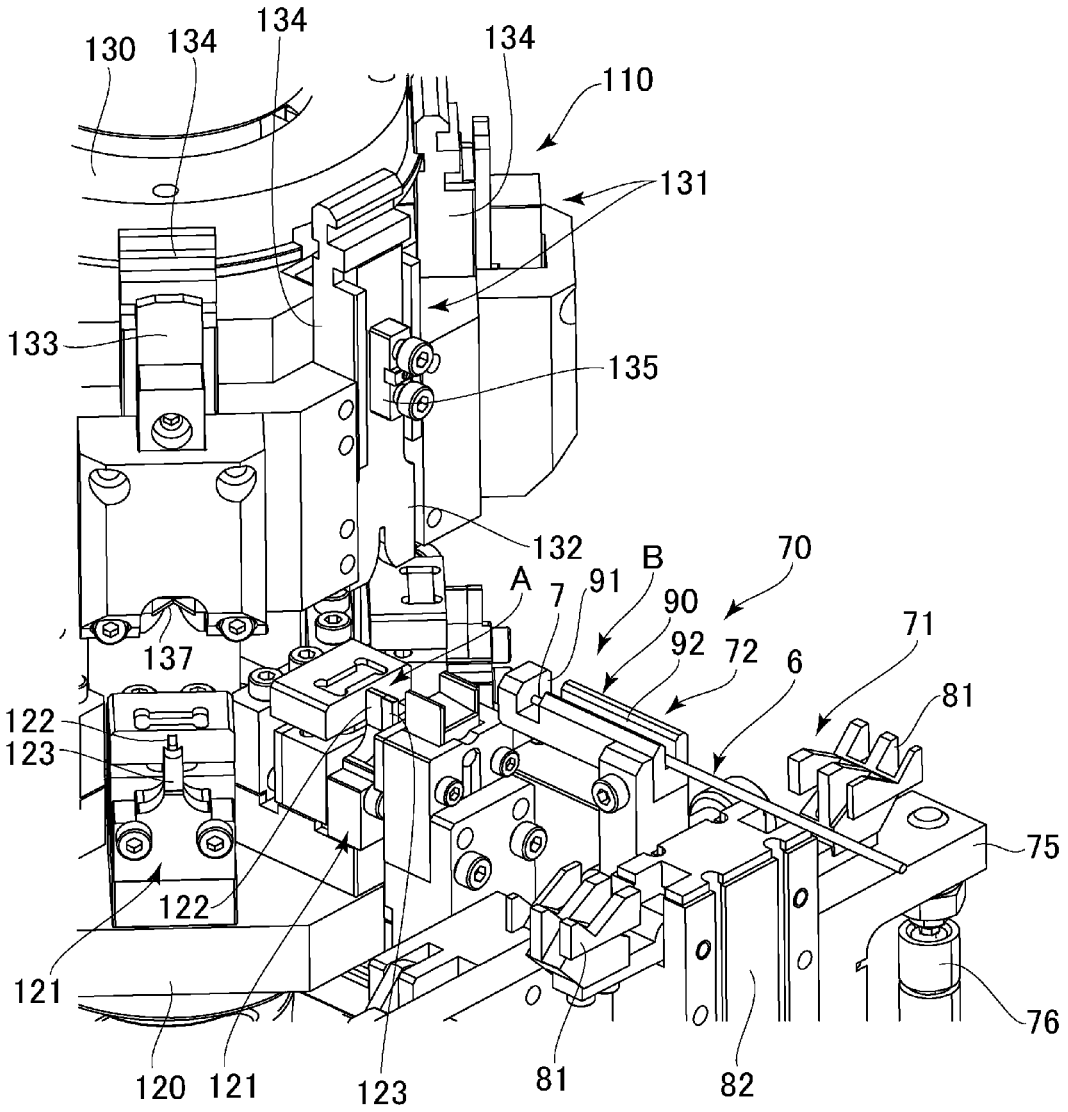
FIG. 16 is a main part perspective view in a state in which a coated crimper shown in FIG. 15 is removed.

FIG. 13 is a perspective view illustrating the electric wire supply part 70 and a multiapplicator 110, FIG. 14 is a perspective view when the crimping position is viewed from the right side, and FIGS. 15 and 16 are perspective views when the crimping position is viewed from the left side.

As shown in FIGS. 13 to 16, the electric wire supply part 70 includes an electric wire gripping part 71 and an electric wire positioning part 72. The electric wire gripping part 71 is supported by a pedestal 73. The pedestal 73 is slid in electric wire supply direction (Y), which is the front and rear direction of the terminal crimping device 10, by a feeding mechanism part 74 having an electric cylinder 78.

The electric wire gripping part 71 is supported to be movable with respect to the pedestal 73 in an up and down direction (Z) through an angle 75. An air cylinder 76 is provided between the pedestal 73 and the angle 75 and the electric wire gripping part 71 is lifted by the air cylinder 76.

The electric wire gripping part 71 includes a pair of holding claws 81. The pair of holding claws 81 are supported to be rotatable mutually in approaching and separating directions. These holding claws 81 are opened or closed by an air cylinder 82. By closing the holding claws 81 in a state in which the electric wire 6 is positioned between these holding claws 81, the electric wire 6 is gripped by the holding claws 81 and by opening the holding claws 81, the gripping of the gripped electric wire 6 is released.

As shown in FIG. 15, the electric wire positioning part 72 is positioned at an electric wire positioning position B on the crimping position A side with respect to the electric wire gripping part 71. The electric wire positioning part 72 includes a positioning block 90. The positioning block 90 includes an electric wire abutting surface 91 and an electric wire housing groove 92. In the positioning block 90, the vicinity of the end part of the electric wire 6 of which the conductor 7 is exposed is housed in the electric wire housing groove 92 and the end part of the conductor 7 abuts on the electric wire abutting surface 91. Thus, the electric wire 6 which is set to the electric wire positioning part 72 by an operator is positioned at the electric wire positioning position in a state in which the electric wire is positioned. The positioning block 90 is fixed to an oscillating end of a rotation bar 94 through a fixing bar 93. The rotation bar 94 is supported to be rotatable with respect to a column 96 which is vertically erected on the stand 11. In addition, the electric wire positioning part 72 includes an air cylinder 95 which is connected to the stand 11 and the rotation bar 94. By driving the air cylinder 95, the rotation bar 94 is rotated. Thus, the positioning block 90 is moved between the electric wire positioning position B and a retreat position deviated downward from the electric wire positioning position B.

As shown in FIGS. 10 to 12, the terminal crimping part 100 includes the multiapplicator 110 and a pressing mechanism 140. The multiapplicator 110 and the pressing mechanism 140 are supported by the stand 11 and the pressing mechanism 140 is supported above the multiapplicator 110.

As shown in FIG. 13, the multiapplicator 110 includes a rotation shaft 111 which is supported in a vertical direction. To the lower end part of the rotation shaft 111, a rotational driving motor 113 constituted by a servo motor is connected through an orthogonal shaft gearbox 112. The rotation shaft 111 is rotated by transmitting the rotational driving force of the rotational driving motor 113 to the rotation shaft through the orthogonal shaft gearbox 112.

The rotation shaft 111 includes an anvil support table 120 and a crimper support table 130. The crimper support table 130 is positioned on the upper side of the anvil support table 120. On the anvil support table 120, a plurality of anvils 121 (8 in this example) are provided at regular intervals in the circumferential direction. On the crimper support table 130, a plurality of crimpers 131 (8 in this example) are provided at regular intervals in the circumferential direction. The anvils 121 and the crimpers 131 are positioned at positions that are matched with each other in the circumferential direction so as to be paired with each other. In this manner, the terminal crimping part 100 includes a rotary type multiapplicator 110 having a plurality of pairs of anvils 121 and crimpers 131 on the rotation shaft 111.

As shown in FIGS. 14 to 16, a wire anvil 122 and a coated anvil 123 are supported on each of the anvils 121. In each of the crimpers 131, a wire crimper 132 and a coated crimper 133 are provided.

The wire crimper 132 and the coated crimper 133 are attached to a crimper holder 134. The crimper holder 134 is supported to be slidable in the up and down direction and is constantly biased to the upper side by a biasing member (not illustrated) in the crimper 131. Thus, the wire crimper 132 and the coated crimper 133 in the crimper 131 are separated from the wire anvil 122 and the coated anvil 123 in the anvil 121. The wire crimper 132 is fixed to the crimper holder 134 by a screw through a sliding block 135 engaged to a long hole 133*a* formed in the coated crimper 133 (refer to FIG. 19). The coated crimper 133 is attached to be slidable with respect to the crimper holder 134 through the sliding block 135. Thus, the coated crimper 133 is set to be relatively movable with respect to the wire crimper 132 in the up and down direction. On the front surface side of the coated crimper 133, an electric wire pressing mechanism 137 which elastically presses the electric wire 6 when caulking the electric wire is provided.

In the multiapplicator 110, the rotation shaft 111 is rotated by the rotational driving motor 113 and any pair of the anvil 121 and the crimper 131 are positioned on the crimping position A side. In this state, the wire anvil 122 and the coated anvil 123 of the anvil 121 positioned on the crimping position A side are positioned under the crimping position A, and the wire crimper 132 and the coated crimper 133 of the crimper 131 positioned on the crimping position A side are positioned above the crimping position A.

Figure 17:
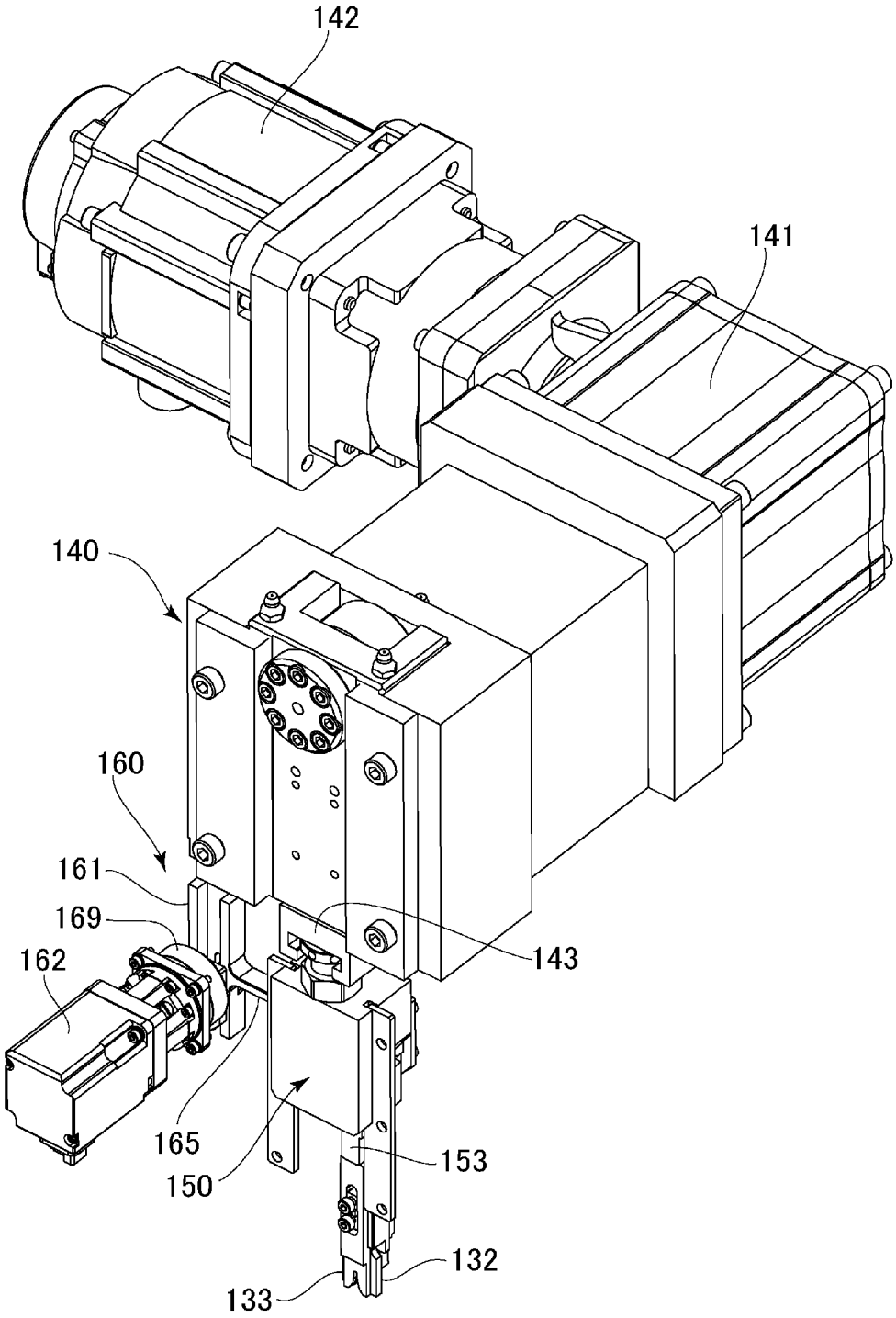
FIG. 17 is a perspective view illustrating a pressing mechanism when viewed from the front side.
Figure 18:
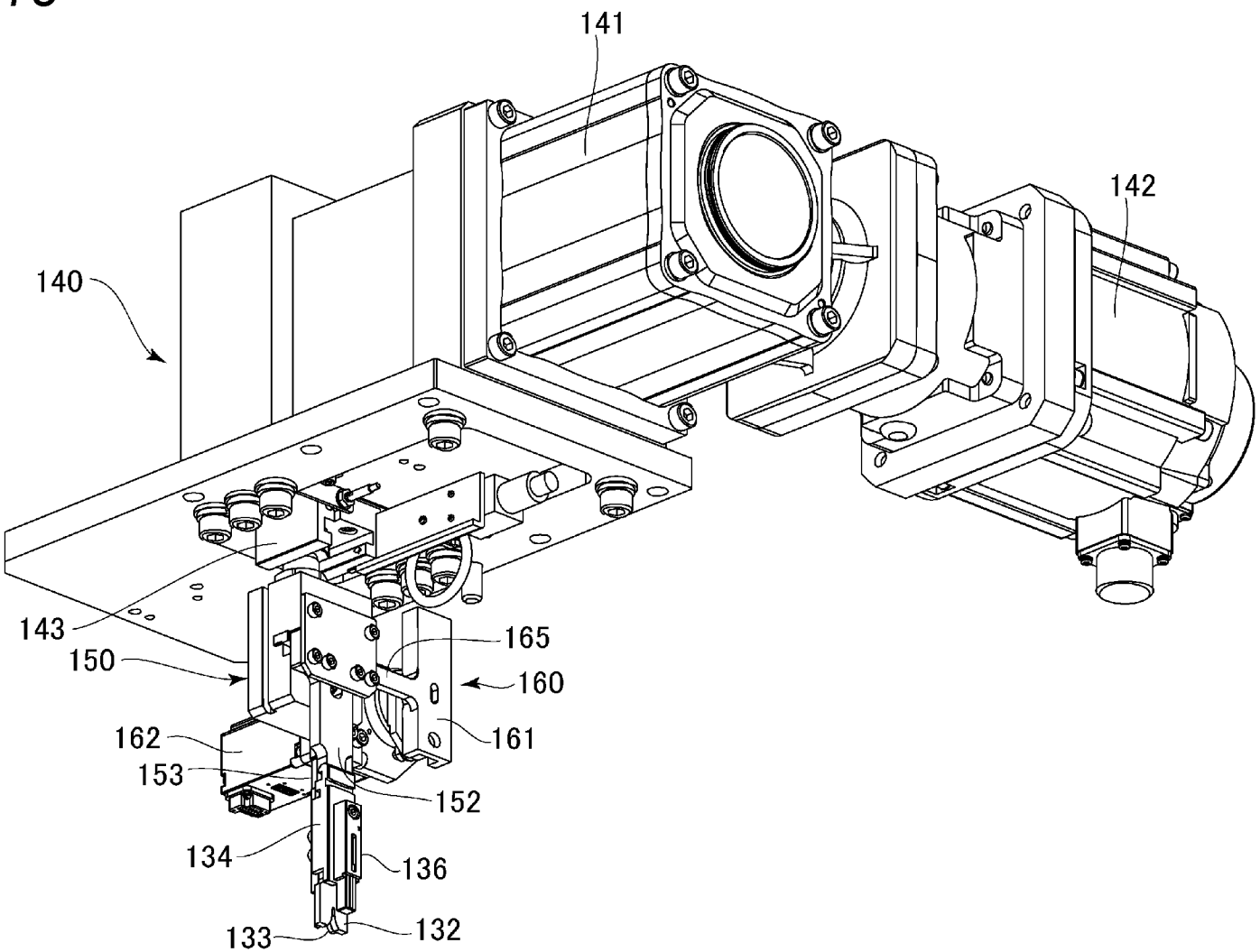
FIG. 18 is a perspective view illustrating the pressing mechanism when viewed from the rear side.

FIGS. 17 and 18 are perspective views illustrating the pressing mechanism 140 when viewed from the front side and the rear side.

As shown in FIGS. 17 and 18, a driving motor 142 constituted by a servo motor is connected to the pressing mechanism 140 through an orthogonal gearbox 141. A press ram 143 is connected to a crank shaft (not illustrated) provided on an output shaft of the orthogonal gearbox 141 in the pressing mechanism 140. The press ram 143 is lifted by transmitting the driving force of the driving motor 142 to the press ram through the orthogonal gearbox 141 and the crank shaft.

A pressing block 150 is attached to the lower part of the press ram 143. A wire crimper pressing plate (wire crimper pressing part) 152 and a coated crimper pressing plate (coated crimper pressing part) 153 are attached to the pressing block 150. The wire crimper pressing plate 152 is fixed to the pressing block 150 by a screw.

The end part of the wire crimper pressing plate 152 is engaged with the upper end part of the crimper holder 134 positioned above the crimping position A. In addition, the lower end part of the coated crimper pressing plate 153 is positioned on the upper end part of the coated crimper 133 positioned above the crimping position A. On the back surface side of the crimper holder 134, a holder pressing mechanism 136 which elastically presses the locking plate 33 of the terminal holder 31 from the upper side when the electric wire is caulked is provided.

Figure 19:
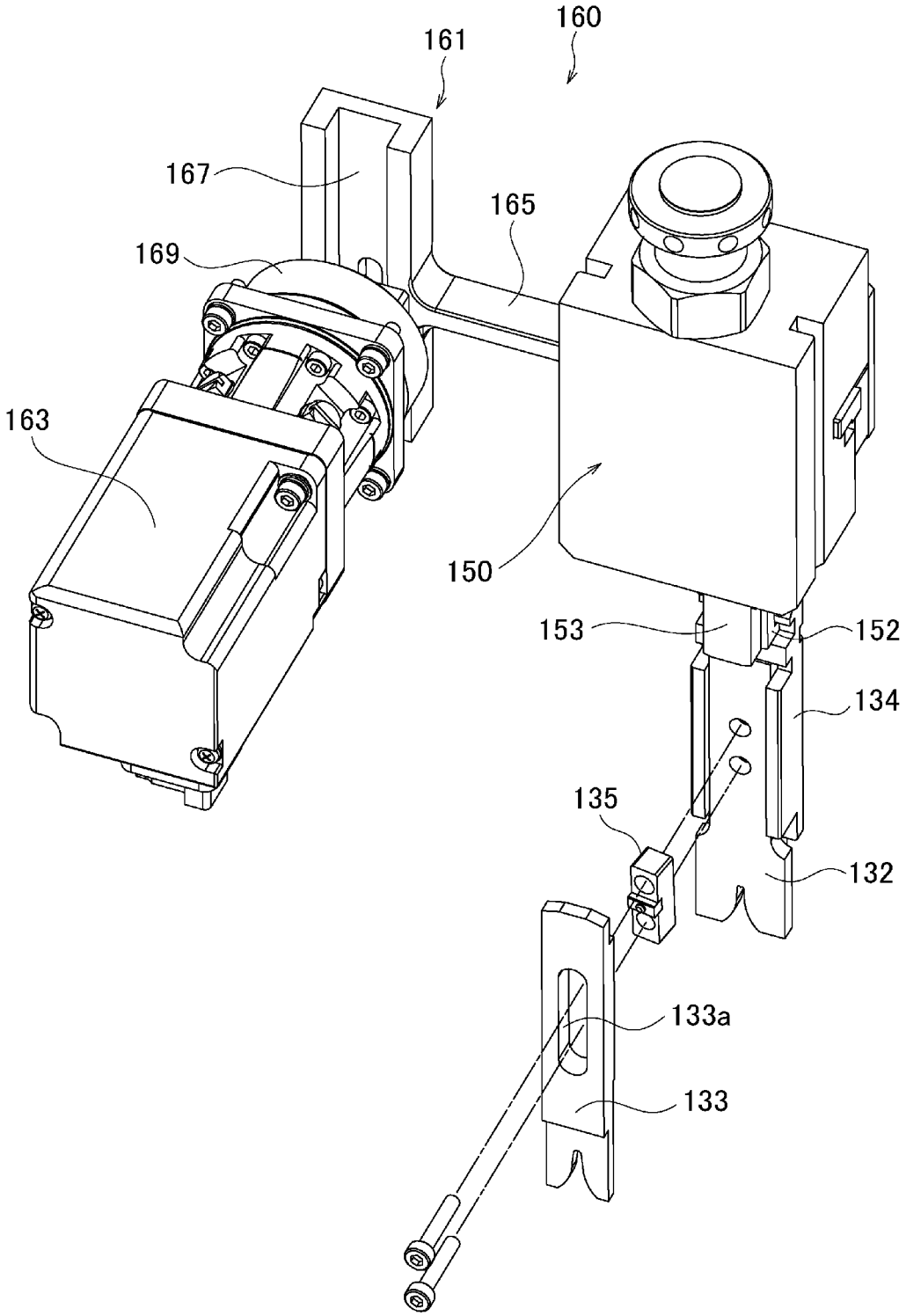
FIG. 19 is a perspective view illustrating a height adjusting mechanism.
Figure 20A:
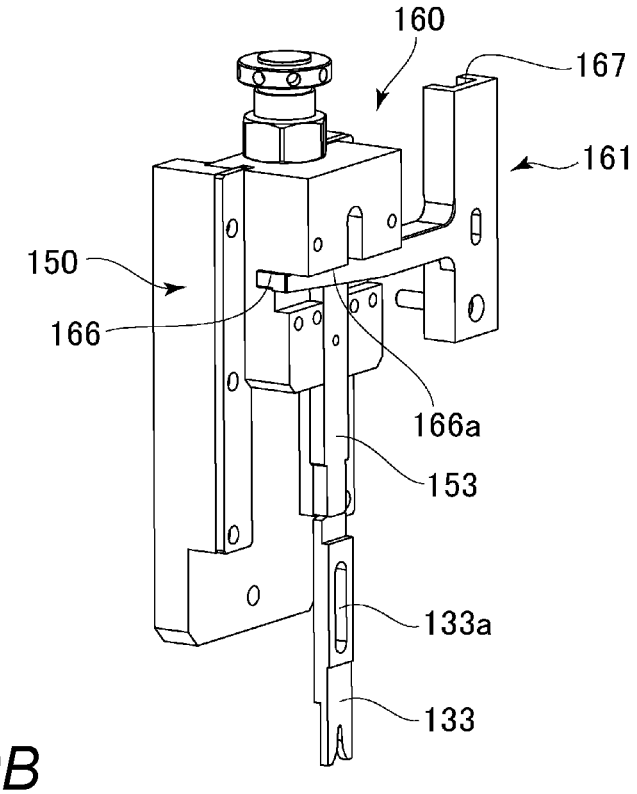
Figure 20B:
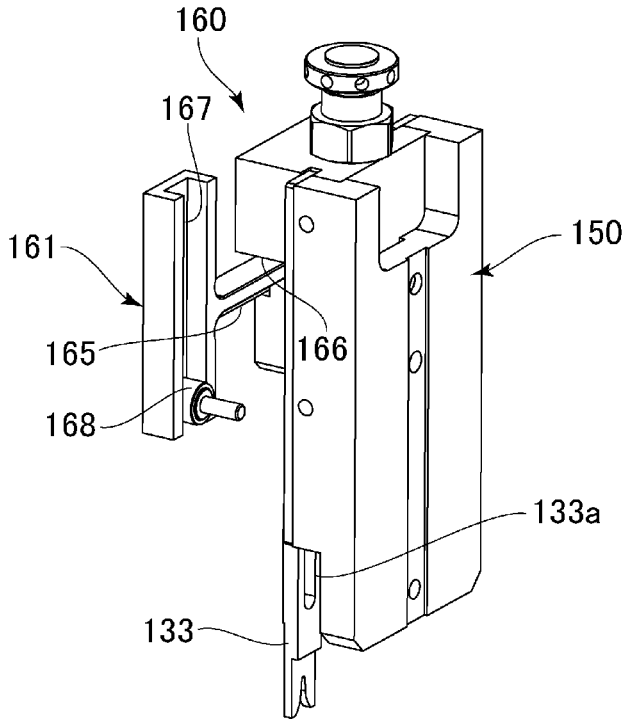
Figure 21A:
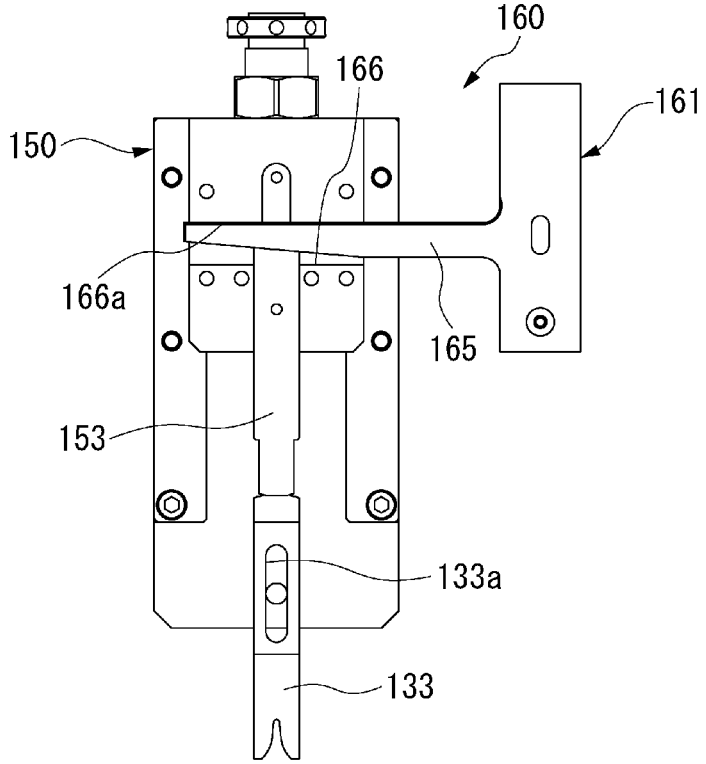
Figure 21B:
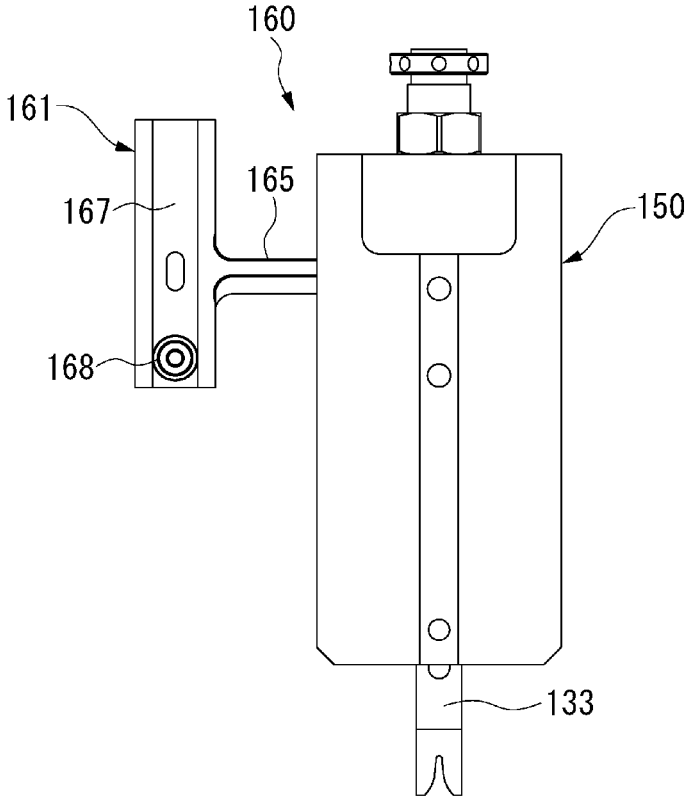

FIG. 19 is a perspective view illustrating a height adjusting mechanism 160. FIGS. 20A and 20B are a perspective views illustrating the pressing block 150 when viewed from the rear side and the front side. FIGS. 21A and 21B are a back view and a front view illustrating the pressing block 150.

As shown in FIG. 19, the pressing block 150 includes a height adjusting mechanism 160. The height adjusting mechanism 160 adjusts the relative height position of the coated crimper pressing plate 153 with respect to the wire crimper pressing plate 152. The height adjusting mechanism 160 includes a wedge member 161 and a driving motor 162 constituted by a servo motor.

As shown in FIGS. 20A to 21B, the wedge member 161 includes a wedge part 165 extending from one edge. The wedge part 165 is formed in a tapered shape gradually narrowed toward the tip end and is inserted into a horizontal engaging groove 166 formed in the pressing block 150. The wedge part 165 inserted into the horizontal engaging groove 166 is inserted between a wall surface 166*a* on the upper side of the horizontal engaging groove 166 and the upper end part of the coated crimper pressing plate 153. The wedge member 161 is supported to be movable in a horizontal direction which is an extending direction of the wedge part 165 in a state in which the movement of the wedge member in the up and down direction (Z) is regulated. The wedge part 165 is inserted into the horizontal engaging groove 166 by moving the wedge member 161 in the horizontal direction. In addition, the wedge member 161 includes a sliding groove 167 formed along the vertical direction. In the sliding groove 167, a driven roller 168 provided with the driving motor 162 is housed. The driven roller 168 is provided at an eccentric position of a disk 169 provided on the rotation shaft of the driving motor 162.

In the height adjusting mechanism 160, the disk 169 is rotated by driving the driving motor 162 and the driven roller 168 provided at the eccentric position of the disk 169 is slid into the sliding groove 167. Then, the wedge member 161 is displaced in the horizontal direction and an insertion amount of the wedge part 165 of the wedge member 161 into the horizontal engaging groove 166 is changed. Thus, a relative position between the pressing block 150 and the coated crimper pressing plate 153 in the vertical direction is changed and the height of the coated crimper pressing plate 153 is adjusted relative to the wire crimper pressing plate 152.

Next, a terminal crimping method of crimping and connecting the terminal metal fitting 1 to the electric wire 6 by using the terminal crimping device 10 having the above configuration will be described.

Setting of Terminal Metal Fitting 1 to Terminal Magazine 21

The terminal metal fitting 1 which is crimped to the electric wire 6 is held by the terminal holder 31 attached to the terminal magazine 21 (terminal holding step). Specifically, in a state in which the locking plate 33 of the terminal holder 31 is opened, the electrical connection part 2 of the terminal metal fitting 1 is housed in the holding groove 34 of the holder block 32 to cause the tip end to abut on the abutting pin 37. Then, the locking plate 33 is closed by rotation (refer to FIGS. 7A and 7B). In this manner, the electrical connection part 2 of the terminal metal fitting 1 is held by the terminal holder 31 and the electric wire connection part 3 projects to the side of the terminal holder 31 (refer to FIG. 6).

Setting of Terminal Magazine 21 to Terminal Supply Part 20

The terminal magazine 21 in which the terminal metal fitting 1 is held by the terminal holder 31 is set to the slide rail 42 of the terminal supply mechanism 41 constituting the terminal supply part 20. At this time, the projection part 24 of the supporting stand 22 is fitted into the rail groove 45 and the slit 25*a* of the engaging member 25 is engaged with the projection part 57*a* of the connection block 57 (refer to FIG. 5). In this manner, the terminal magazine 21 is supported to be slidable on the slide rail 42 of the terminal supply mechanism 41, and the terminal magazine 21 is connected to the slider 55 of the horizontal moving mechanism 43 through the connection plate 56.

Transport of Terminal Metal Fitting 1

When the terminal magazine 21 is set to the terminal supply mechanism 41 of the terminal supply part 20 and the crimping operation of the terminal metal fitting 1 is started by the terminal crimping device 10, the slider 55 is slid by the left and right moving mechanism part 51 and the terminal magazine 21 connected to the slider 55 is slid (moved) to the crimping position A on the slide rail 42 in the terminal transport direction (X) (magazine moving step). Thus, the terminal metal fitting 1 held by the terminal holder 31 of the terminal magazine 21 is transported to the crimping position A and the terminal metal fitting 1 to be crimped is positioned at the crimping position A.

(Positioning of Terminal Metal Fitting 1)

Immediately before the terminal metal fitting 1 to be crimped is transported to the crimping position A, the electric wire connection part 3 of the terminal metal fitting 1 is photographed by the camera 44 (terminal photographing step).

As shown in FIG. 12, on the rear side of the slide rail 42 (the left side in FIG. 4) corresponding to a range photographed by the camera 44, an air cylinder 201 fixed to the rail supporting stand 59 is positioned. The air cylinder 201 causes a pressing pin (not illustrated) to project to the front side of the slide rail 42 so as to press and bias the upper side of the rear end of the locking plate 33 of the terminal holder 31 holding the terminal metal fitting 1 to be photographed. Then, the locking plate 33 is rotated in the closing direction and the rattling of the terminal metal fitting 1 housed in the holding groove 34 is removed. Accordingly, the electric wire connection part 3 of the terminal metal fitting 1 is photographed by the camera 44 without deviation.

Video data obtained by photographing the electric wire connection part 3 of the terminal metal fitting 1 positioned at the crimping position A is transmitted from the camera 44 to the control device 12.

In the control device 12, based on the video image photographed by the camera 44, the position deviation of the electric wire connection part 3 of the terminal metal fitting 1 with respect to the crimping position A is examined (position deviation examining step). For example, a position deviation amount in which the position of the edge part of the electric wire connection part 3 which becomes a reference of the conductor crimp part 4 is deviated from a predetermined position of the crimping position A is detected. As a result, in a case where position deviation occurs in the electric wire connection part 3, the control device 12 controls the horizontal moving mechanism 43 to perform a positioning process of correcting the position deviation of the electric wire connection part 3 with respect to a predetermined position of the crimping position A and matching the position of the terminal metal fitting 1 with the predetermined position of the crimping position A (terminal positioning step). Specifically, the position of the terminal magazine 21 in the terminal transport direction (X) is adjusted by the left and right moving mechanism part 51, and the position of the slide rail 42 in the electric wire supply direction (Y) is adjusted by the front and rear moving mechanism part 52. Thus, the electric wire connection part 3 of the terminal metal fitting 1 to be crimped is positioned at the predetermined position of the crimping position A with high accuracy.

(Selection of Applicator)

When the crimping operation of the terminal metal fitting 1 is started by the terminal crimping device 10, a pair of the anvil 121 and the crimper 131 corresponding to the terminal metal fitting 1 to be crimped which is positioned at the crimping position A are selected in the multiapplicator 110. Then, the rotation shaft 111 is rotated by driving the rotational driving motor 113 and the selected anvil 121 and crimper 131 are positioned on the crimping position A side (anvil and crimper positioning step). In this state, the upper end part of the crimper holder 134 of the crimper 131 is engaged with the lower end part of the wire crimper pressing plate 152, and the lower end part of the coated crimper pressing plate 153 is positioned on the upper end part of the coated crimper 133.

(Supply of Electric Wire 6)

The operator determines the position of the electric wire at the electric wire positioning position B by housing the end part of the electric wire 6 of which the conductor 7 is exposed in the electric wire housing groove 92 of the positioning block 90 and causing the end part of the conductor 7 to abut on the electric wire abutting surface 91, and starts an electric wire supply operation.

Then, in the electric wire supply part 70, the holding claws 81 of the electric wire gripping part 71 are closed by the air cylinder 82, and the electric wire 6 is gripped by the holding claws 81. Then, the rotation bar 94 is rotated by the air cylinder 95 and the positioning block 90 is moved to a retreat position deviated from the electric wire positioning position B.

The electric wire gripping part 71 is moved to the crimping position A in the electric wire supply direction (Y) by the feeding mechanism part 74 and is lowered the air cylinder 76. Thus, the end part of the electric wire 6 of which the conductor 7 is exposed is supplied to the crimping position A and is set to the electric wire connection part 3 of the terminal metal fitting 1 (electric wire setting step).

(Crimping of Terminal Metal Fitting 1)

When the electric wire 6 is set on the electric wire connection part 3 of the terminal metal fitting 1 at the crimping position A, the driving motor 142 of the pressing mechanism 140 in the terminal crimping part 100 is driven to lower the pressing block 150 together with the press ram 143.

Then, the wire crimper pressing plate 152 fixed to the pressing block 150 is lowered and the wire crimper 132 fixed to the crimper holder 134 is pressed down. In addition, when the pressing block 150 is lowered, the coated crimper pressing plate 153 provided in the pressing block 150 is also lowered, and the coated crimper 133 supported by the crimper holder 134 is pressed down. Thus, in the electric wire connection part 3 of the terminal metal fitting 1 positioned at the crimping position A, a conductor crimping piece 4*a* of the conductor crimp part 4 is caulked to the conductor 7 by the wire anvil 122 and the wire crimper 132 and a coated crimping piece 5*a* of the coated crimp part 5 is caulked to the part of the coating 8 by the coated anvil 123 and the coated crimper 133 (terminal caulking step). As a result, the terminal metal fitting 1 is crimped to the conductor 7 of the electric wire 6 having the conductor crimp part 4 exposed at the end part in the electric wire connection part 3 and the coated crimp part 5 is crimped to the part of the coating 8 of the electric wire 6. Thus, the terminal metal fitting 1 is crimped and connected to the electric wire 6.

When the crimping of the terminal metal fitting 1 to the electric wire 6 is completed, a holding releasing pin (not illustrated) driven by the air cylinder 205 projects from the deep side of the crimping position A and the lower side of the rear end of the locking plate 33 of the terminal holder 31 holding the crimped terminal metal fitting 1 is pressed and biased. Then, the locking plate 33 is opened by rotating in the opening direction and the crimped terminal metal fitting 1 is extractable from the holding groove 34 of the holder block 32. Thereafter, in the terminal crimping device 10, a crimping operation for the terminal metal fitting 1 to be crimped next is started.

(Position Adjustment of Crimper)

The press down amount of the wire crimper 132 and the coated crimper 133 in the crimper 131 is adjusted by the driving motor 142 of the pressing mechanism 140 constituted by a servo motor. However, there are a plurality of kinds of terminal metal fittings 1 having electric wire connection parts 3 corresponding to various electric wires 6 having different diameters and kinds of conductors 7 and coatings 8. Further, the size and the shape of the electric wire connection parts 3 of the terminal metal fittings 1 may be slightly different according to differences of the manufacturing location and manufacturing lot. Accordingly, it is necessary to adjust the press down amount of the wire crimper 132 and the coated crimper 133 according to the size and the shape of the terminal metal fitting 1 and the kind and the diameter of the electric wire 6 to which the terminal metal fitting 1 is crimped.

Therefore, in the terminal crimping device 10 according to the embodiment, the press down amount of the wire crimper 132 is adjusted in accordance with the crimp height of the conductor crimp part 4 (the height of the conductor crimp part) by the driving motor 142 of the pressing mechanism 140 and the press down amount of the coated crimper 133 according to the crimp height of the coated crimp part 5 (the height of the coated crimp part) is adjusted by the height adjusting mechanism 160 provided in the pressing block 150 according to the press down amount of the wire crimper 132 (crimper adjusting step).

Specifically, the disk 169 is rotated by driving the driving motor 162 of the height adjusting mechanism 160. Then, by sliding the driven roller 168 provided at the eccentric position of the disk 169 into the sliding groove 167, the wedge member 161 is displaced in the horizontal direction according to the rotation angle of the disk 169 and the insertion amount of the wedge part 165 of the wedge member 161 into the horizontal engaging groove 166 is changed. Thus, the relative position between the pressing block 150 and the coated crimper pressing plate 153 is changed. Accordingly, the relative height position between the wire crimper pressing plate 152 and the coated crimper pressing plate 153 fixed to the pressing block 150 is adjusted and the relative height position between the wire crimper 132 and the coated crimper 133 is adjusted. Thus, the conductor crimp part 4 and the coated crimp part 5 can be crimped with high accuracy according to the size and the shape of the terminal metal fitting 1 and the kind and the diameter of the electric wire 6 to which the terminal metal fitting 1 is crimped.

As described above, according to the terminal crimping device 10 of the embodiment, based on the video image photographed by the camera 44, the control device 12 controls the horizontal moving mechanism 43 to perform a positioning process of matching the position of the terminal metal fitting 1 with a predetermined position of the crimping position A. Even in a case where the anvil 121 and the crimper 131 are exchanged with change of the kind of the terminal metal fitting 1 to be crimped, the terminal metal fitting 1 can be crimped to the electric wire 6 by positioning the terminal metal fitting 1 at a predetermined position of the crimping position A corresponding to the exchanged anvil 121 and crimper 131 with high accuracy, and thus productivity and quality can be improved.

In the terminal crimping device 10 according to the embodiment, the relative height position between the wire crimper 132 and the coated crimper 133 can be adjusted by the height adjusting mechanism 160 according to the size and the shape of the terminal metal fitting 1 and the kind and the diameter of the electric wire 6 to which the terminal metal fitting 1 is crimped. Here, the press down amount of the coated crimper 133 according to the crimp height of the coated crimp part 5 can be easily adjusted in accordance with the press down amount of the wire crimper 132 according to the crimp height of the conductor crimp part 4. Accordingly, even in a case where the size and the shape of the terminal metal fitting 1 to be crimped and the kind and the diameter of the electric wire 6 are changed, labor for the adjustment operation is further reduced. Thus, productivity can be increased and quality can also be improved.

In the terminal crimping device 10 according to the embodiment, the relative height position between the wire crimper pressing plate 152 and the coated crimper pressing plate 153 is adjusted by inserting the wedge part 165 of the height adjusting mechanism 160 between the pressing block 150 and the coated crimper pressing plate 153, and thus the relative position between the wire crimper 132 and the coated crimper 133 can be easily adjusted.

In the terminal crimping device 10 according to the embodiment, among a plurality of pairs of anvils 121 and crimpers 131 provided in the multiapplicator 110, a pair of the anvil 121 and the crimper 131 corresponding to the terminal metal fitting 1 to be crimped are selected, and the terminal metal fitting 1 positioned at a predetermined position of the crimping position A by the selected anvil 121 and crimper 131 with high accuracy is crimped to the electric wire 6. Accordingly, a plurality of kinds of terminal metal fittings 1 can be rapidly crimped to the electric wires 6 with high accuracy and productivity and quality can be improved even in the production of many kinds in small quantities.

In the terminal crimping device 10 according to the embodiment, by mounting the terminal magazine 21 in which the various terminal metal fittings 1 are respectively held by the plurality of kinds of terminal holders 31 on the terminal supply mechanism 41, the various terminal metal fittings 1 held by the terminal holders 31 are transported to the crimping position A and is sequentially crimped to the electric wires 6. Accordingly, a plurality of supply devices for supplying the terminal metal fittings 1 do not need to be provided for each kind of terminal metal fittings 1, and the size of the terminal crimping device 10 can be reduced, and an installation space can be reduced.

According to the terminal crimping method of the embodiment, based on the video image of the electric wire connection part 3 of the terminal metal fitting 1 photographed by the camera 44, a positioning process of matching the position of the electric wire connection part 3 with a predetermined position of the crimping position A is performed. Even in a case where, among a plurality of pairs of anvils 121 and crimpers 131, a pair of the anvil 121 and the crimper 131 corresponding to the terminal metal fitting 1 to be crimped are selected with change of the kind of the terminal metal fitting 1 to be crimped, and the terminal metal fitting 1 is crimped to the electric wire 6 by the selected pair of the anvil 121 and the crimper 131, labor for the adjustment operation in which the electric wire connection part 3 of the terminal metal fitting 1 is positioned at a predetermined position of the crimping position A corresponding to the exchanged pair of the anvil 121 and the crimper 131 can be reduced, and the electric wire connection part 3 of the terminal metal fitting 1 can be positioned at the predetermined position of the crimping position A with high accuracy to crimp the terminal metal fitting to the electric wire 6. Thus, productivity and quality can be improved.

In the terminal crimping method according to the embodiment, by adjusting the press down amount of the wire crimper 132 according to the crimp height of the conductor crimp part 4 and adjusting the press down amount of the coated crimper 133 according to the crimp height of the coated crimp part 5 according to the press down amount of the wire crimper 132, even in a case where the size and the shape of the terminal metal fitting 1 to be crimped and the kind and the diameter of the electric wire 6 are changed, labor for the adjustment operation is reduced. Thus, productivity can be increased and quality can be improved.

In the terminal crimping method according to the embodiment, by transporting the terminal magazine 21 in which various terminal metal fittings 1 are respectively held by a plurality of terminal holders 31 to the crimping position A, the terminal metal fitting 1 is sequentially crimped to the electric wires 6. Here, a plurality of supply devices for supplying the terminal metal fittings 1 do not need to be provided for each kind of terminal metal fittings 1, the size of the terminal crimping device 10 can be reduced, and an installation space can be reduced.

The present invention is not limited to the above-described embodiments and a change, a modification, and the like can be made in an appropriate manner. In addition, materials, shapes, dimensions, numbers, disposition sites, and the like of each constitutional component in the above-described embodiments which can achieve the present invention are arbitrary and not limited.

For example, the posture of inclination or the like of the electric wire connection part 3 of the terminal metal fitting 1 is detected by the camera 44 and in a case where the electric wire connection part 3 is inclined, the terminal crimping device 10 may be stopped or a mechanism capable of adjusting the inclination of the terminal metal fitting 1 held by the terminal holder 31 may be provided to correct the inclination.

In addition, by providing an automatic machine for causing each terminal holder 31 of the terminal magazine 21 to hold the terminal metal fittings 1, and an automatic machine for transporting the electric wire to the electric wire supply part 70 by removing the coating 8 at the end part of the electric wire 6 to expose the conductor 7, the working efficiency can be further improved.

In the embodiment, the height adjusting mechanism 160 which adjusts the relative height position of the coated crimper pressing plate 153 relative to the wire crimper pressing plate 152 is provided. However, the height adjusting mechanism 160 may adjust the relative height position of the wire crimper pressing plate 152 relative to the coated crimper pressing plate 153.

Here, the features of the above-described embodiments of the terminal crimping device and terminal crimping method according to the present invention are respectively briefly summarized and positioned in the following [1] to [8].

[1] A terminal crimping device (10) which crimps a terminal metal fitting (1) positioned at a crimping position (A) to an electric wire (6), the device comprising:

an anvil (121) which is positioned under the crimping position (A);

a crimper (131) which is positioned above the crimping position (A);

a pressing mechanism (140) which presses down the crimper (131) to crimp the terminal metal fitting (1) to the electric wire (6) with the anvil (121) and the crimper (131);

a terminal supply mechanism (41) to supply the terminal metal fitting (1) to the crimping position (A);

a position adjusting mechanism (horizontal moving mechanism 43) which is provided in the terminal supply mechanism (41) to adjust a position of the terminal metal fitting (1) for the crimping position (A);

a photographing device (camera 44) to photograph the terminal metal fitting (1) fed to the crimping position (A); and a control device (12) which controls the position adjusting mechanism (horizontal moving mechanism 43) based on a video image photographed by the photographing device (camera 44) to perform a positioning process of matching a position of the terminal metal fitting (1) with a predetermined position of the crimping position (A).

[2] The terminal crimping device according [1], wherein the anvil (121) includes a wire anvil (122) and a coated anvil (123), wherein the crimper (131) includes a wire crimper which is paired with the wire anvil (122) to caulk the terminal metal fitting (1) to a conductor (7) of the electric wire (6), and a coated crimper (133) which is paired with the coated anvil (123) to caulk the terminal metal fitting (1) to a coating (8) part of the electric wire (6), and wherein the pressing mechanism (140) includes a wire crimper pressing part (wire crimper pressing plate 152) which presses down the wire crimper (132), a coated crimper pressing part (coated crimper pressing plate 153) which presses down the coated crimper (133), and a height adjusting mechanism (160) which adjusts a relative height position between the wire crimper pressing part (wire crimper pressing plate 152) and the coated crimper pressing part (coated crimper pressing plate 153).

[3] The terminal crimping device according to [2], wherein the wire crimper pressing part (wire crimper pressing plate 152) and the coated crimper pressing part (coated crimper pressing plate 153) are attached to a pressing block (150) in which is lifted by the pressing mechanism (140), and wherein the height adjusting mechanism (160) includes a wedge part (165) which is inserted between the pressing block (150) and the wire crimper pressing part (wire crimper pressing plate 152) or between the pressing block (150) and the coated crimper pressing part (coated crimper pressing plate 153) to change a relative position between both members.

[4] The terminal crimping device according to any one [1] to [3], further comprising:

a multiapplicator (110) including a plurality of pairs of the anvils (121) and the crimpers (131) respectively crimping a plurality of kinds of terminal metal fittings (1) to the electric wires (6), wherein the multiapplicator (110) selects a pair of the anvil (121) and the crimper (131) corresponding to the terminal metal fitting (1) fed to the crimping position and positioned the anvil and the crimper at the anvil crimping position (A).

[5] The terminal crimping device according to any one of [1] to [4], wherein a terminal magazine (21) in which a plurality of terminal holders (31) which respectively hold the various terminal metal fittings (1) are positioned is detachably attached to the terminal supply mechanism (41), and wherein the terminal supply mechanism (41) transports the terminal metal fittings (1) held by the terminal holders (31) to the crimping position (A) by moving the terminal magazine (21).

[6] A terminal crimping method comprising:

photographing an electric wire connection part (3) of the terminal metal fitting (1) by a photographing device (camera 44) from an upper side before transporting a terminal metal fitting (1) to be crimped to an electric wire (6) to a crimping position (A) (terminal photographing step);

performing a positioning process of matching a position of the terminal metal fitting (1) with a predetermined position of the crimping position (A) based on a video image photographed by the photographing device (camera 44) (terminal positioning step);

selecting, among a plurality of pairs of anvils (121) and crimpers (131), a pair of the anvil and the crimper corresponding to the terminal metal fitting (1) to be crimped and positioning the anvil (121) and the crimper (131) at the crimping position (A) (anvil and crimper positioning step);

setting an end part of the electric wire (6) of which a conductor (7) is exposed on the electric wire connection part (3) positioned on the anvil (121) supplied to the crimping position (A) (electric wire setting step); and caulking the electric wire connection part (3) with the pair of the anvil (121) and the crimper (131) (terminal caulking step).

[7] The terminal crimping method according to [6], further comprising:

adjusting a press down amount of the wire crimper (132) in the crimper (131) according to a crimp height of a conductor crimp part (4) in the electric wire connection part (3) and adjusting a press down amount of the coated crimper (133) in the crimper (131) according to a crimp height of a coated crimp part (5) in the electric wire connection part (3) according to the press down amount of the wire crimper (132) (crimper adjusting step).

[8] The terminal crimping method according to [6] or [7], further comprising:

holding the terminal metal fitting (1) by at least one terminal holder (31) attached to a terminal magazine (21) (terminal holding step); and moving the terminal magazine (21) in which the terminal metal fitting (1) is held by the terminal holder (31) to the crimping position (A) in a terminal transport direction (magazine moving step).

DESCRIPTION OF REFERENCE NUMERALS AND SIGNS

1: Terminal metal fitting
6: Electric wire
10: Terminal crimping device
12: Control device
21: Terminal magazine
31: Terminal holder
41: Terminal supply mechanism
43: Horizontal moving mechanism (position adjusting mechanism)
44: Camera (photographing device)
110: Multiapplicator
121: Anvil
122: Wire anvil
123: Coated anvil
131: Crimper
132: Wire crimper
133: Coated crimper
140: Pressing mechanism
150: Pressing block
152: Wire crimper pressing plate (wire crimper pressing part)
153: Coated crimper pressing plate (coated crimper pressing part)
160: Height adjusting mechanism
165: Wedge part
A: Crimping position

What is claimed is:

1. A terminal crimping method comprising:

transporting a terminal metal fitting to be crimped to an electric wire to a crimping position by a terminal supply mechanism;

photographing an electric wire connection part of the terminal metal fitting by a photographing device from an upper side before transporting the terminal metal fitting to the crimping position by the terminal supply mechanism;

performing a positioning process of matching a position of the electric wire connection part of the terminal metal fitting with a predetermined position of the crimping position based on a video image photographed by the photographing device;

selecting, among a plurality of pairs of anvils and crimpers, a pair of an anvil and a crimper corresponding to the terminal metal fitting to be crimped and positioning the anvil and the crimper at the crimping position;

setting an end part of the electric wire of which a conductor is exposed on the electric wire connection part positioned on the anvil supplied to the crimping position; and caulking the electric wire connection part to the end part of the electric wire with the pair of the anvil and the crimper, wherein the performing the positioning process includes detecting a position deviation amount in which a position of an edge part of the electric wire connection part is deviated from the predetermined position of the crimping position, and controlling a position adjusting mechanism provided with the terminal supply mechanism based on the detected position deviation amount, the position of the edge part of the electric wire connection part being a reference of a conductor crimp part transported to the crimping position by the terminal supply mechanism.

2. The terminal crimping method according to claim 1, wherein the crimper includes a wire crimper and a coated crimper, the method further comprising:

adjusting a press down amount of the wire crimper according to a crimp height of a conductor crimp part in the electric wire connection part and adjusting a press down amount of the coated crimper according to a crimp height of a coated crimp part in the electric wire connection part according to the press down amount of the wire crimper.

3. The terminal crimping method according to claim 1, further comprising:

holding the terminal metal fitting by at least one terminal holder attached to a terminal magazine; and moving the terminal magazine in which the terminal metal fitting is held by the terminal holder to the crimping position in a terminal transport direction.

* * * * *